US010053854B2

(12) United States Patent
Hildestad

(10) Patent No.: US 10,053,854 B2
(45) Date of Patent: Aug. 21, 2018

(54) BEAM CONNECTOR FOR ARCH STRUCTURE

(71) Applicant: Roy Hildestad, Los Angeles, CA (US)

(72) Inventor: Roy Hildestad, Los Angeles, CA (US)

( * ) Notice: Subject to any disclaimer, the term of this patent is extended or adjusted under 35 U.S.C. 154(b) by 0 days.

(21) Appl. No.: 15/489,723

(22) Filed: Apr. 17, 2017

(65) Prior Publication Data

US 2017/0298612 A1 Oct. 19, 2017

Related U.S. Application Data

(60) Provisional application No. 62/323,553, filed on Apr. 15, 2016.

(51) Int. Cl.

| | |
|---|---|
| ***E04B 1/32*** | (2006.01) |
| ***E04B 7/08*** | (2006.01) |
| ***E04C 3/38*** | (2006.01) |
| *E04B 1/26* | (2006.01) |
| *E04B 1/24* | (2006.01) |

(52) U.S. Cl.

CPC ..... *E04B 1/3205* (2013.01); *E04B 1/2608* (2013.01); *E04B 1/32* (2013.01); *E04B 2001/2415* (2013.01); *E04B 2001/2463* (2013.01); *E04B 2001/2616* (2013.01); *E04B 2001/2644* (2013.01); *E04B 2001/2684* (2013.01); *E04B 2001/3241* (2013.01); *E04B 2001/3276* (2013.01)

(58) Field of Classification Search

CPC .. E04B 1/32; E04B 1/3205; E04B 2001/3241; E04B 2001/3276; E04B 1/3211; E04B 2001/3252; E04B 2001/3288; E04B 2001/3294

See application file for complete search history.

(56) References Cited

U.S. PATENT DOCUMENTS 1,840,041 A * 1/1932 Kellogg ..... E04B 7/063 24/338
4,009,543 A * 3/1977 Smrt ..... E04L 31/3211 52/222
4,117,636 A * 10/1978 Smith ..... A01G 9/1407 24/486
4,194,851 A * 3/1980 Littlefield ..... E04L 31/3211 403/218

(Continued)

*Primary Examiner* — Brian D Mattei

(74) *Attorney, Agent, or Firm* — Donald L. Bartels; Bartels Law Group

(57) ABSTRACT

The invention is a structural connector used as a component to construct an arch consisting of a plurality of closely adjacent, polygonal rows of stringer beams. The multiple row polygonal arch is a low-cost, general purpose support structure for bridges, shelters and arbors applicable to many cost-, time- or environmentally-sensitive situations. The invention is a Y-shaped connector, typically made of sheet metal, with three brackets, two upper brackets and a lower bracket, which collectively enable a union of three beams forming one node of the multiple row polygonal arch. Using these Y-shaped connectors to join the beams at each node creates the arch structure, and additionally provides the features of cantilevering, modularity, generic component shape, reusability and safety. The invention is applicable to a variety of structures such as: pedestrian and vehicular bridges, shelters, arbors, as well as jewelry, furniture and toys.

8 Claims, 23 Drawing Sheets

(56) References Cited

U.S. PATENT DOCUMENTS

| | | | | | |
|---|---|---|---|---|---|
| 4,729,197 | A * | 3/1988 | Miller | E04L 31/3211 | 403/172 |
| 4,876,828 | A * | 10/1989 | Brill | E04L 31/3205 | 52/222 |
| 6,647,683 | B1 * | 11/2003 | Thomsen | E04D 3/08 | 52/200 |
| 7,017,307 | B2 * | 3/2006 | Jones | E04B 7/063 | 52/200 |
| 9,328,513 | B2 * | 5/2016 | Maguire | E04D 13/0305 | |

* cited by examiner

BEAM CONNECTOR FOR ARCH STRUCTURE

CROSS REFERENCE TO RELATED APPLICATION

This application claims the benefit of U.S. Provisional Patent Application Ser. No. 62/323 553, filed Apr. 15, 2016, the entirety of which is hereby incorporated by reference.

BACKGROUND OF INVENTION

Current designs for double row or larger polygonal arches present difficulties when applied to structures with spans above 40 feet (12 m) that need to meet public load safety standards, or that need to be dismantled easily and reused, or which are constructed without scaffolding, assembled without heavy equipment, and built with bamboo or other locally-available beam materials, or which need to be safely and reliably assembled by non-professionals.

What are needed are connectors that enable the construction of arch-shaped structures either individually or as parallel ribs of cylindrically-shaped structures such as supporting arches for bridges, tunnel linings, Quonset hut-type shelters and arbors. The need is for a connector that enables the construction of arches where the stringer beams are arranged in two or more parallel rows so that the ends of the beams in one row are opposite the midsection of the beams in an adjacent row. Arches constructed from straight beams are desirable because they use lower cost standard components but retain the strength, simplicity and extended span of arches constructed of specially engineered curved components.

The end-to-end alignment of beams in polygonal arches transfers the load placed on the arch to the abutments along the longitudinal axis of each beam. This end-to-end load transfer makes efficient use of the strength of most materials. Although a polygonal arch makes good use of materials, the end-to-end alignment of the beams is unstable. Adding enough bracing to make a single row of beams rigid increases costs and lowers the strength-to-weight ratio. The instability problem is solved by joining at least two parallel, end-to-end aligned rows of beams so that the point where the beams meet in one row is braced by the mid-point of a beam in the adjacent row. The resulting arch is strong, light-weight and uses readily available standard materials.

For most civil engineering projects, the trusses and curved-component arches that can be made of aluminum or steel are more efficient in their use of materials than the double row polygonal arch. However, for many remote, emergency response, environmentally-sensitive or limited-funding situations, the double row or multi-row polygonal arch would be a superior support structure for bridges and larger shelters due to its simplicity, strength and ability to span greater distances with small, human-portable components assembled by unskilled labor. To meet the requirements of these demanding situations, the structure needs to be improved so it can be built quickly and safely out of standard modules in difficult terrain, be constructed of bamboo or other local materials like small diameter timber, and be easily disassembled, transported and reused.

Various designs exist for building arches using straight beams both with and without connectors between the beams, e.g., U.S. Pat. No. 4,412,405, J. J. Tucker; U.S. Pat. No. 1,727,022, T. Ahlborn; U.S. Pat. No. 3,004,302, W. W. Nightingale; U.S. Pat. No. 3,091,002, L. E. Nicholson. Historical arch designs also provide examples, e.g., the 'self-supporting bridge' of Leonardo Da Vinci, bridges in rural China such as Meichong Bridge, Yunhe County, and Xidong Bridge, Taishun County, both in Zhejiang Province, and the Moon Bridge at Huntington Gardens in Pasadena, Calif. Some designs provide modularity, reusability and safety, but the benefits are limited primarily to one material, or to very small structures. A single design which addresses the combined requirements of cantilevering, allowing a wide range of beam materials, and reducing construction time, which can be scaled up to build structures with spans of 20 meters or more, is lacking.

SUMMARY OF INVENTION

The present invention is a structural connector for creating a double row or multi-row polygonal arch using straight beams. The connector joins three straight beams in a triangular union that forms one node of the structure. A series of 'nodes' creates an arch, or a complete circle if enough 'nodes' are added. All the 'nodes' of the arch are established by the connector, all connectors in a single arch can be identical connectors of the type described in the invention, and no other types of connectors are required to assemble the beams into an arch structure. The connector according to the present invention is typically made of sheet metal or steel plate.

The connector is a 'Y'-shaped device with three brackets that bind the ends or middle of beams to the connector. One bracket is located on each arm of the 'Y'. The two brackets at the top of the 'Y' are on the opposite longitudinal face of the connector from the bracket at the bottom of the 'Y' so that the connector joins two beams from one row of beams together end-to-end, and joins the two separate rows of beams in the arch to each other.

The beams inserted into the two brackets at the top of the 'Y'-shape must slope downward at an angle of 1 or more degrees from horizontal in a completed arch. To establish the required slope, the top brackets may be fixed in relation to each other and the bottom bracket at the specific angle required, or allowed to swivel through a range of angles so that the final angle is determined by the length of the beams used and the basic rules of geometry. The bottom bracket is aligned at roughly 90 degrees to the vertical centerline of the connector so that the beam in the bottom bracket is the base of the isosceles-triangle-shaped union and the beams in the top brackets are the sides of the union.

The connector establishes a modular 'building block' for double row or multi-row polygonal arches. One beam with one connector attached to the beam's midsection by the bottom bracket of the connector is the basic construction unit. Each of these 'building blocks' interlocks with other identical blocks turned in the opposite direction. The ends of the beams in opposite-facing 'building blocks' fit into the top brackets of the connectors of its neighboring 'building blocks' creating an interlocking structure.

The connector allows an arch to be assembled in-place, without scaffolding, by creating a series of cantilevers from the arch's abutments to the center of the span. Each 'building block' cantilevers from the next lower block by hanging from its own connector and using the connector of the next lower building block as a counter-balance. At the center of the span, the final 'building block' acts as a 'keystone' joining the two cantilevered half-arches.

Once an arch is complete, the connectors direct the load forces around the arch to the abutments in the same way as the stones in a keystone arch. Each connector also maintains the alignment of the beams in the double row structure of the arch. The brackets of the connector can simply hook over the beams, holding the beams in place by balancing the opposing forces in the top brackets against the bottom bracket. Fasteners holding beams to the brackets are not required but can be used to add convenience during construction, or structural durability. Top brackets may be constructed to fully enclose the ends of the beams, allowing the use of beams made of bundles of smaller elements, like bamboo poles and small diameter timber.

The brackets of the connector can simply hook over the beams, holding the beams in place by balancing the opposing forces in the top brackets against the bottom bracket. Fasteners holding beams to the brackets are not required but can be used to add convenience during construction, or structural durability. top brackets may be constructed to fully enclose the ends of the beams, allowing the use of beams made of bundles of smaller elements, like bamboo poles and small diameter timber.

A transverse beam may be added through the optional transverse notch between the top brackets to connect a single arch to other parallel arches in a multi-arch structure.

The bottom bracket can be configured with a flange, called a "Chaining Hook", which connects the bracket to the adjacent connector in a structure with multiple, closely adjacent parallel arches.

Construction-grade connectors are applicable to bridges, shelters, culverts, tunnels and arbor-like structures. Smaller embodiments of the connector made of thin-gauge metal, plastics, fabric or composites can be used in furniture, toys and small devices. The number, type, composition and size of fasteners required used to assemble the connector and attach beams to the brackets of the connector are application-specific.

DRAWINGS

Figure 8:
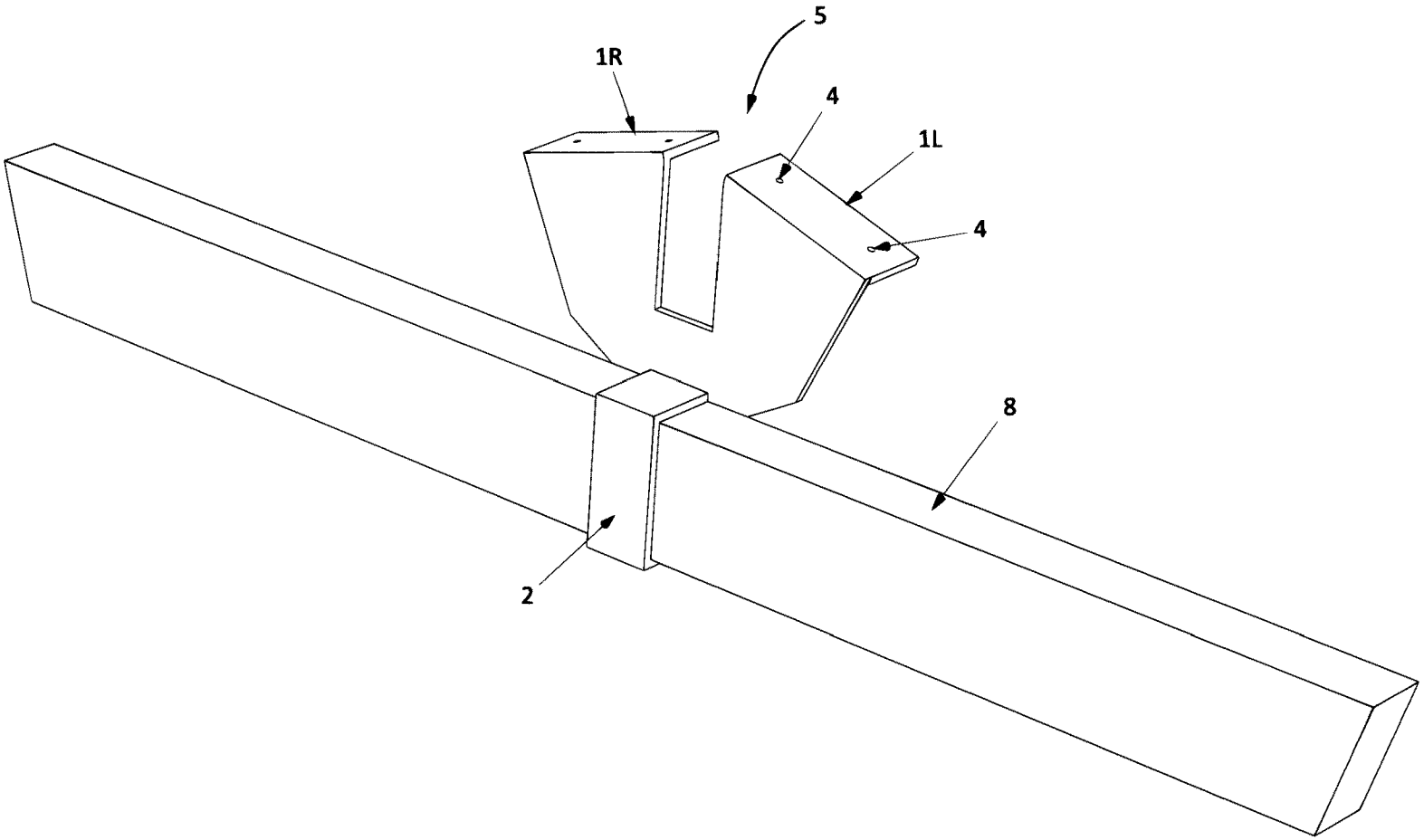

FIG. 8 is a perspective view of the 'building block' established by the invention: a construction module that interlocks with other identical modules to create a double row of polygonal arches. The illustration shows the 'Side-Braced' embodiment of the connector configured with the 'L-shape' type top brackets and the 'Fully-enclosed' type bottom bracket attached to a stringer beam forming a single construction unit.

Figure 9:
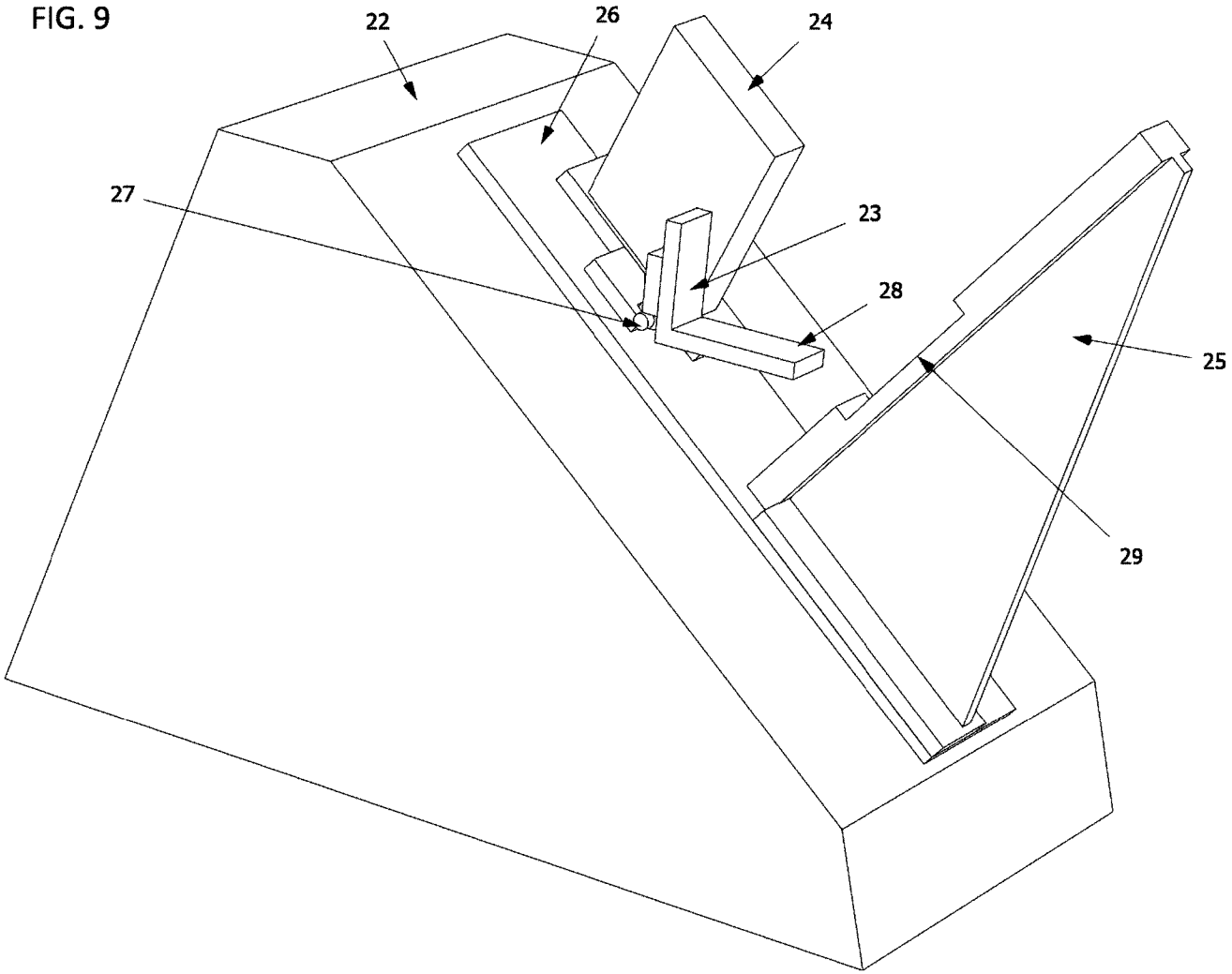

FIG. 9 illustrates a front perspective view of an 'Abutment connection bracket' according to the present invention, including a stub beam, a 'locking angle' and a support brace with a springer 'building block'.

Figure 10A:
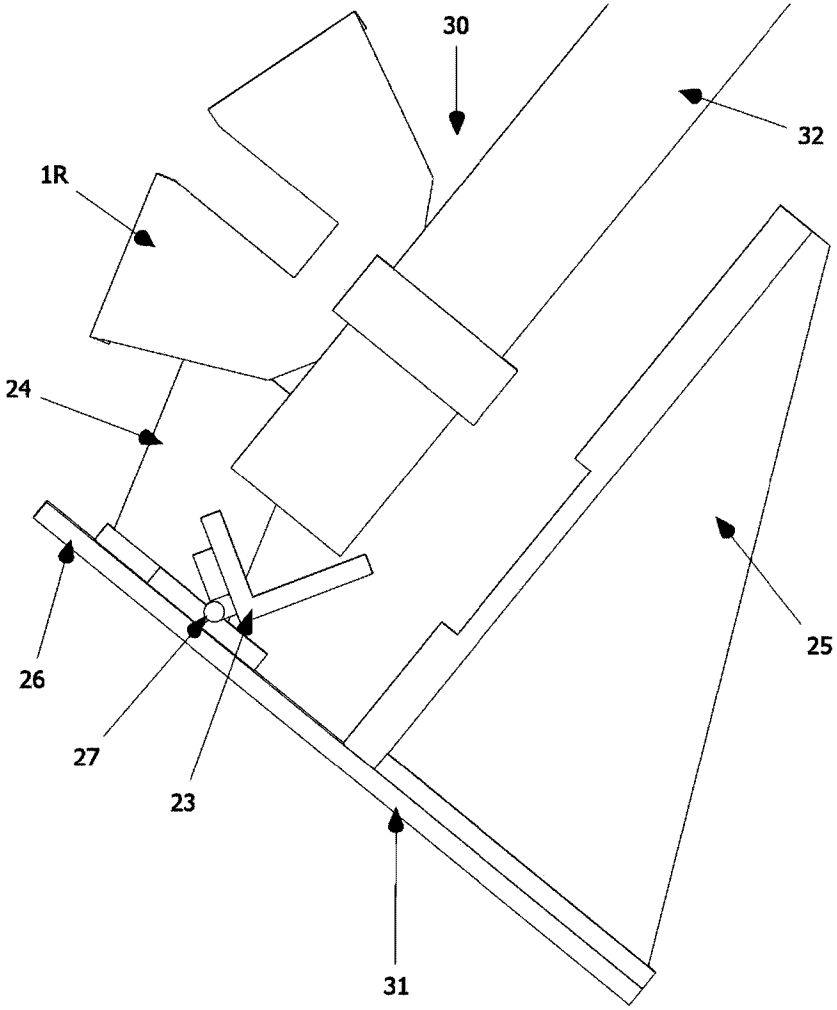
Figure 10B:
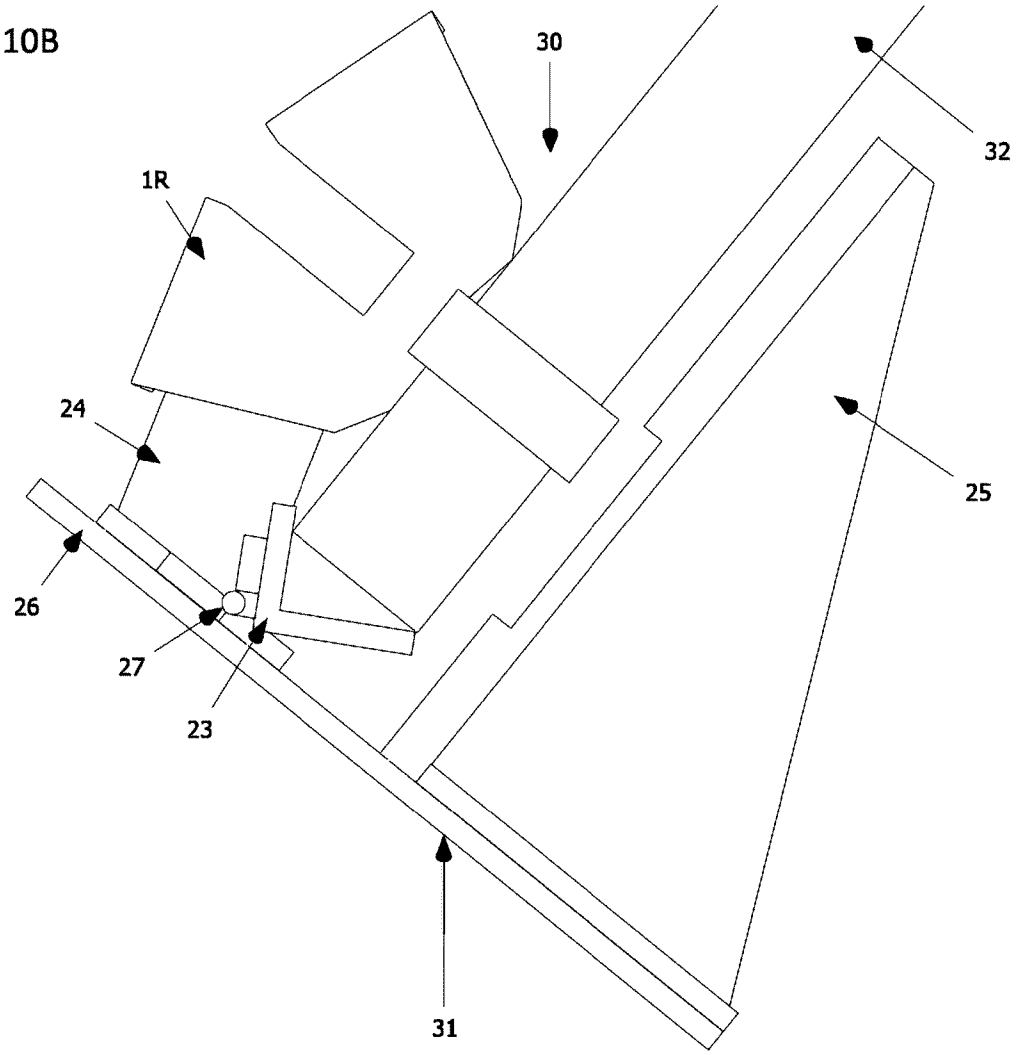
Figure 10C:
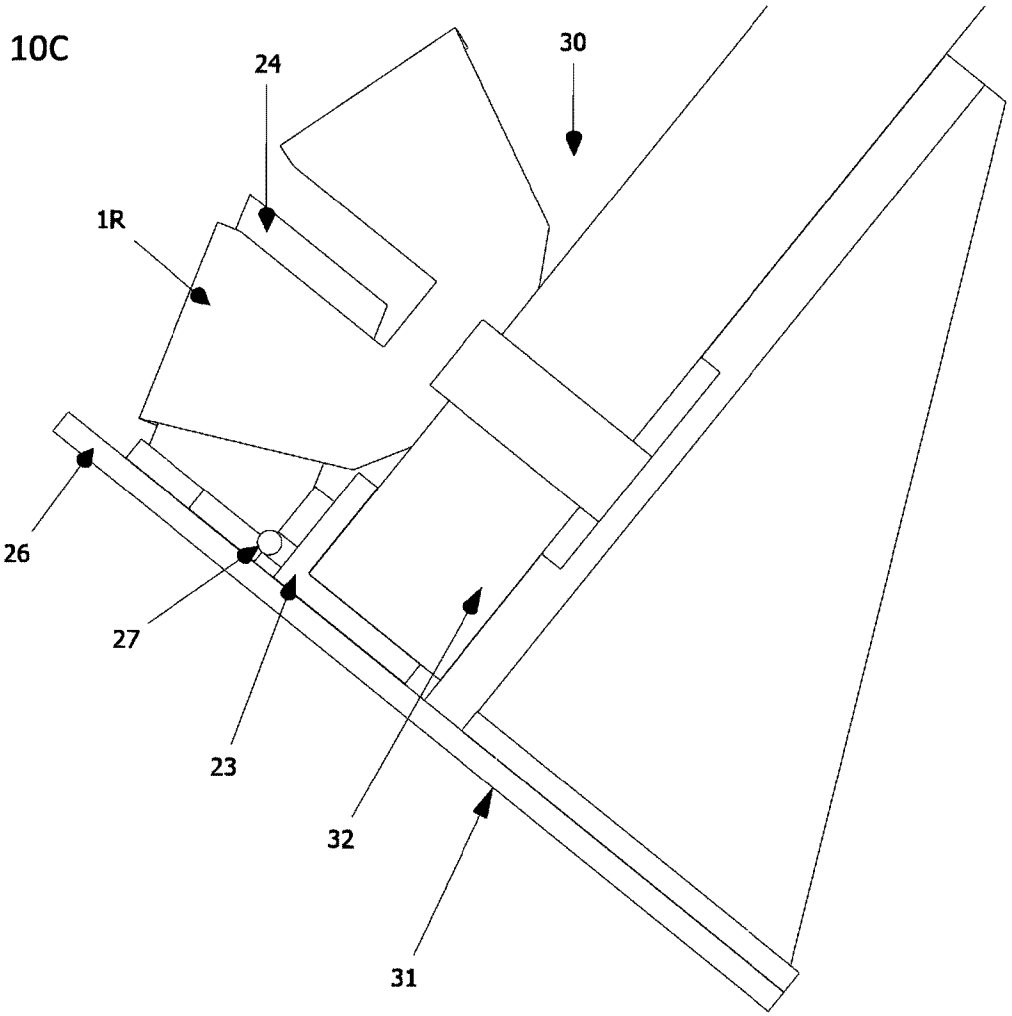

FIGS. 10A, 10B, and 10C are side views illustrating a sequence where a springer building block is being lowered onto the abutment. FIG. 10A shows the initial position of the 'locking angle' when the springer 'building block' starts to be lowered onto the abutment. FIG. 10B shows the rotation of the 'locking angle' as the 'stub beam ' slides into the top bracket of the springer 'building block'. FIG. 10C shows the final positions of the 'locking angle' and springer 'building block '.

Figure 11:
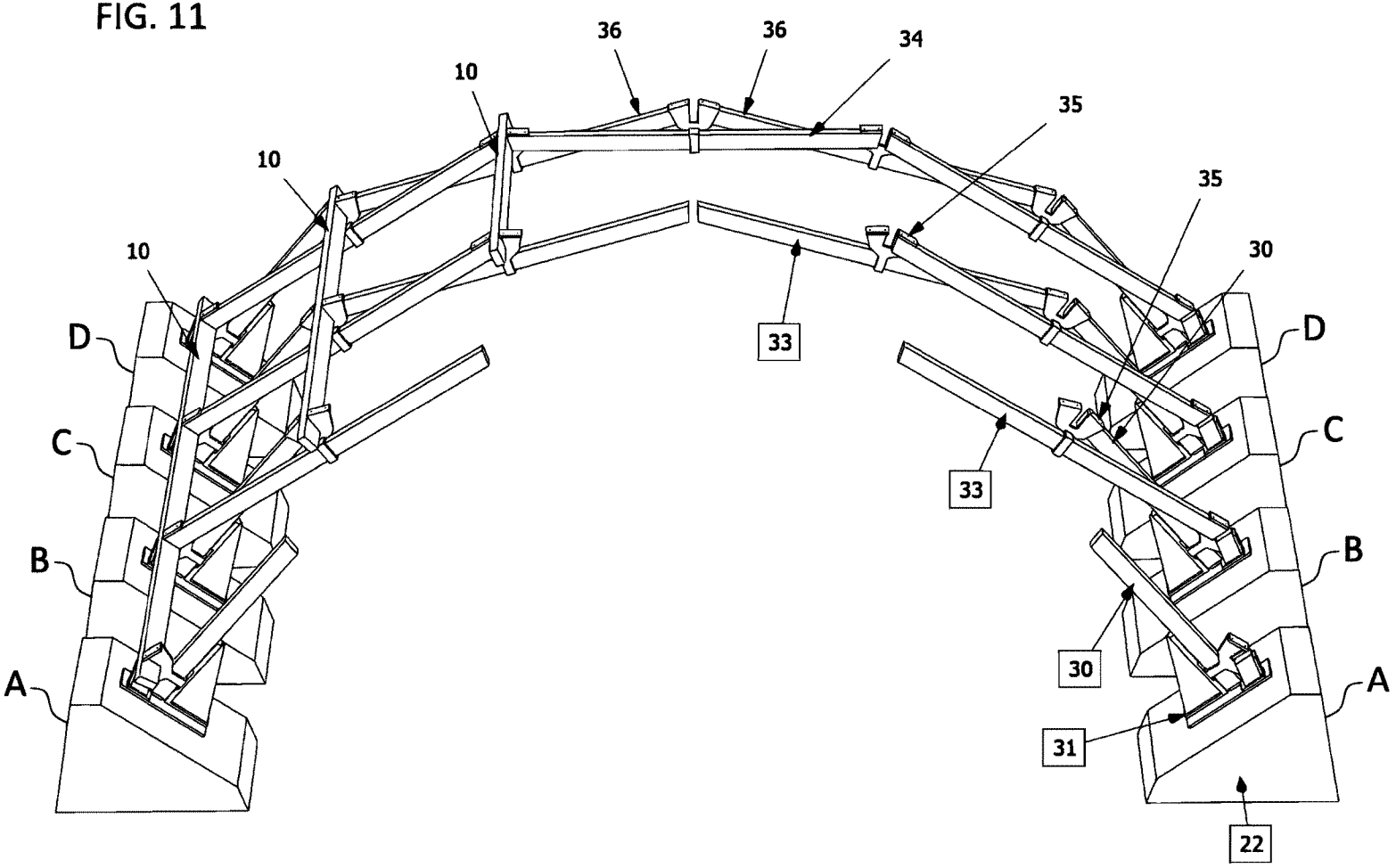

FIG. 11 is a perspective view of a cantilevered assembly sequence using 'building block' modules created with the invention.

Figure 12:
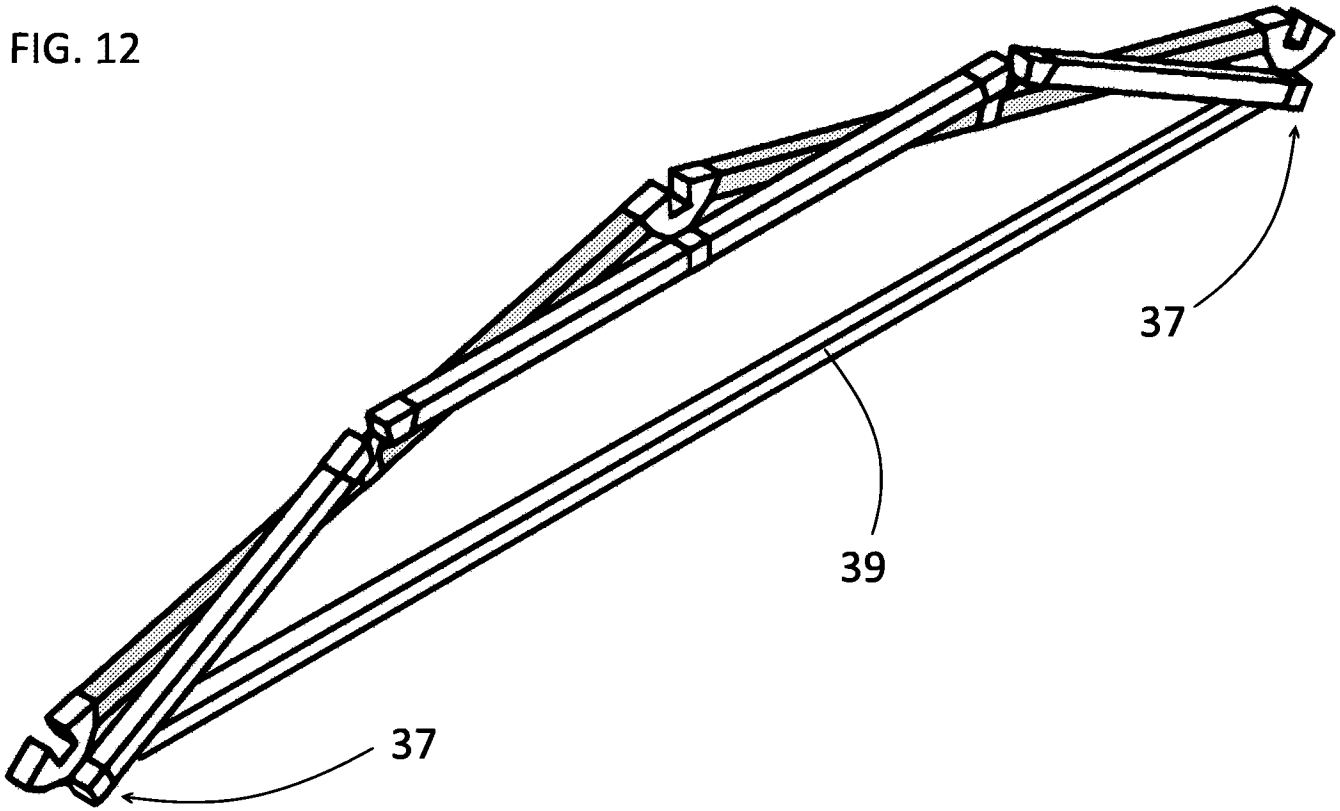

FIG. 12 is a perspective view of a tied arch created according to the invention.

Figure 13:
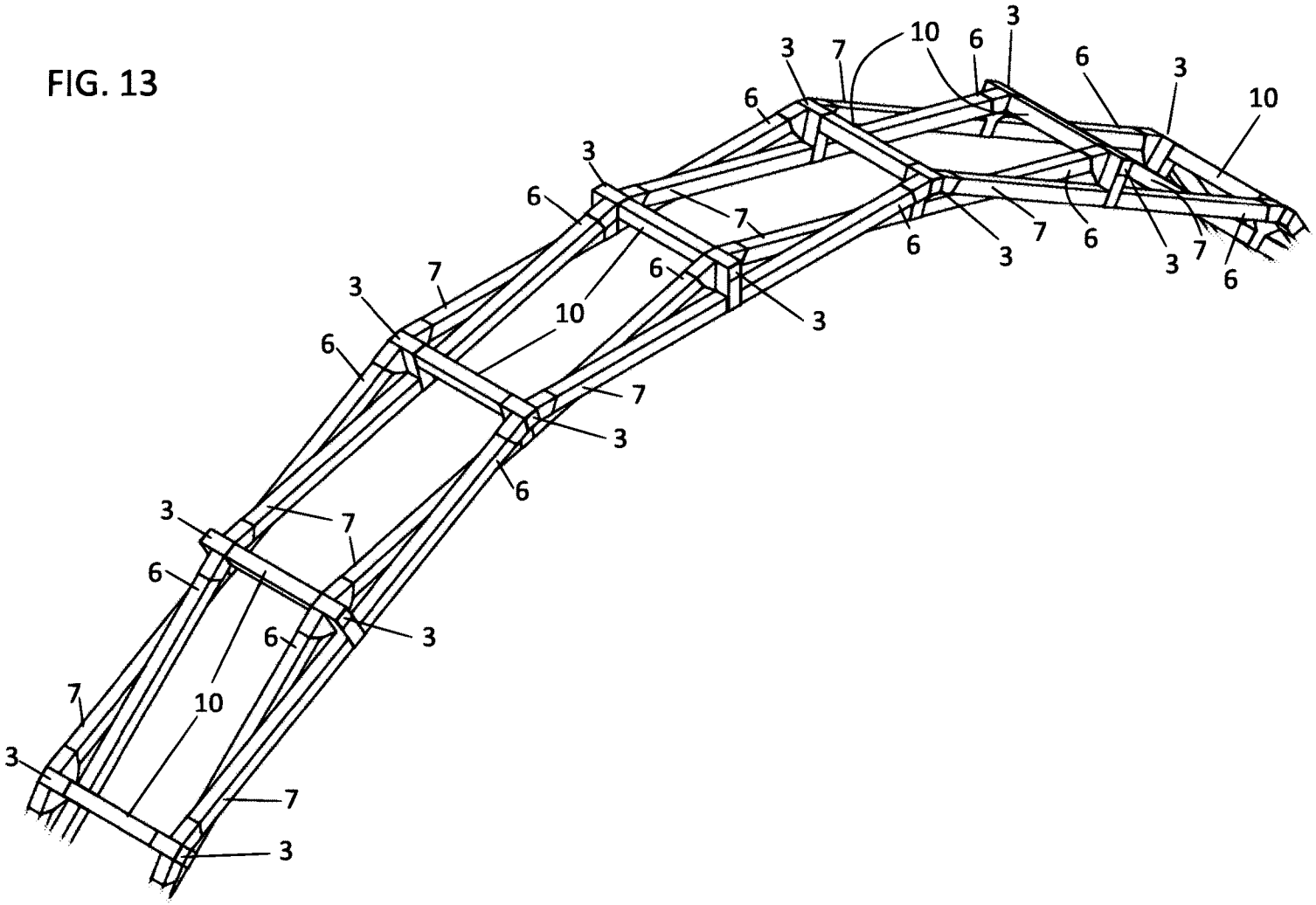

FIG. 13 is a perspective view showing a two arch structure created using Y-shaped connectors according to the present invention where a transverse beam is used at each node to join the arches together.

Figure 14A:
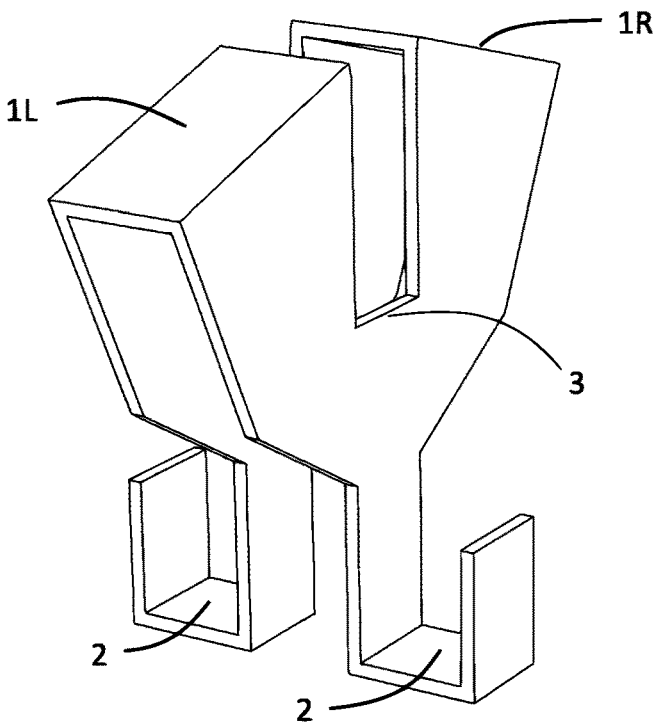

FIG. 14A shows one embodiment of a Y-shaped connector for 3-row polygonal arches. Shown is a Type A connector which has four top brackets and one bottom bracket.

Figure 14B:
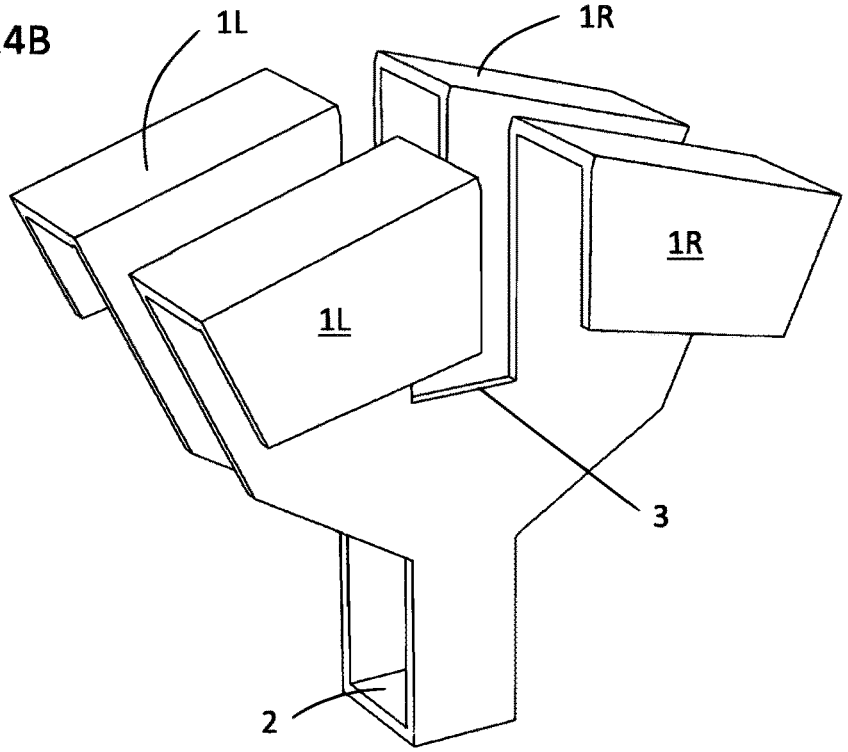

FIG. 14B shows another embodiment of a Y-shaped connectors for 3-row polygonal arches. Shown is a Type B connector which has two top brackets and two bottom brackets.

DETAILED DESCRIPTION

Figure 1A:
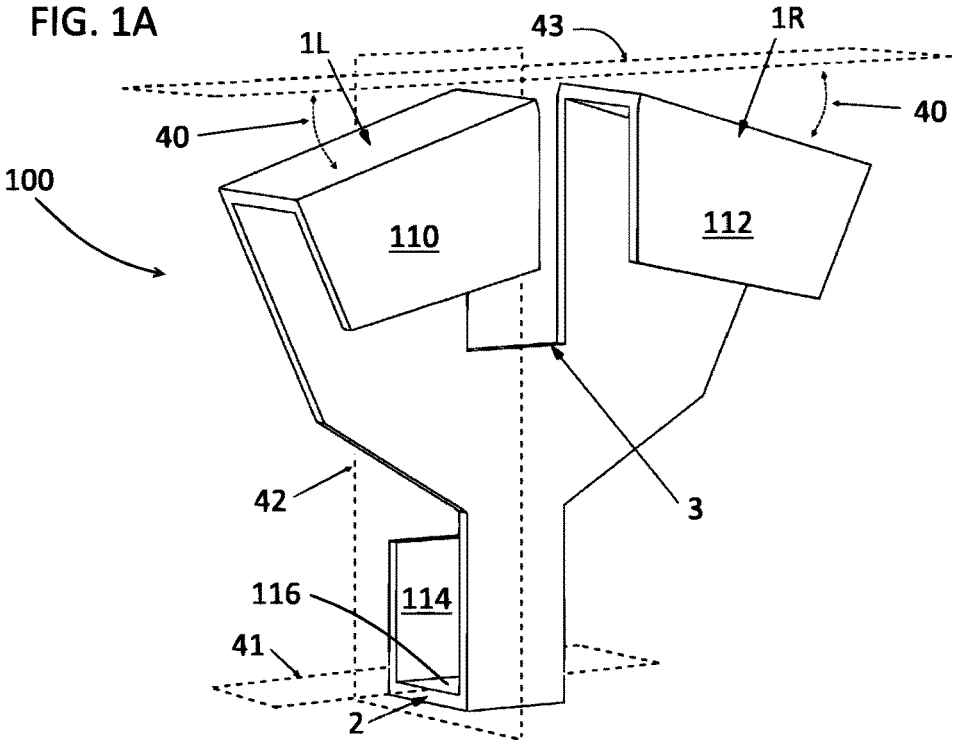
FIG. 1A is a perspective view of one embodiment of the invention showing 'U-shape' type top and bottom brackets.

Referring to FIG. 1A, one embodiment of the invention is a Y-shaped structural connector 100 having three U-shaped brackets designed to bind three stringer beams to the union created by the connector. One U-shaped bracket is located on each arm of the 'Y'. Each of the brackets 110 and 112 form the upper arms 1L, 1R, respectively, of the 'Y' shaped connector 100. Each of these brackets 110, 112 binds the end of a stringer beam to the connector 100. The top brackets are aligned with each other so that they are mirror images of each other relative to the vertical, front-to-back midplane 42 of the connector 100. The U-shaped bracket 114 forms the bottom arm 2 of connector 100. Bracket 114 binds the midsection of a third stringer beam to the connector 100. The bottom bracket 114 is aligned with the top brackets 110 and 112 so that a beam fully inserted into either top bracket 110, 112 will slope toward the level of the bottom surface 116 of the bottom bracket 114. Both top brackets extend downward at an angle 40 that is greater than zero from the transverse plane 43 of the connector 100. The transverse plane 43 of connector 100 is always parallel to the bottom surface 116 on which the beam inserted in the bottom bracket 114 or the tangent to the lowest point of the beam, if the beam is cylindrical.

In the FIG. 1A embodiment, the two top brackets are separated by a space, a transverse notch 3, which enables a transverse beam to be inserted into the connector 100.

Figure 1B:
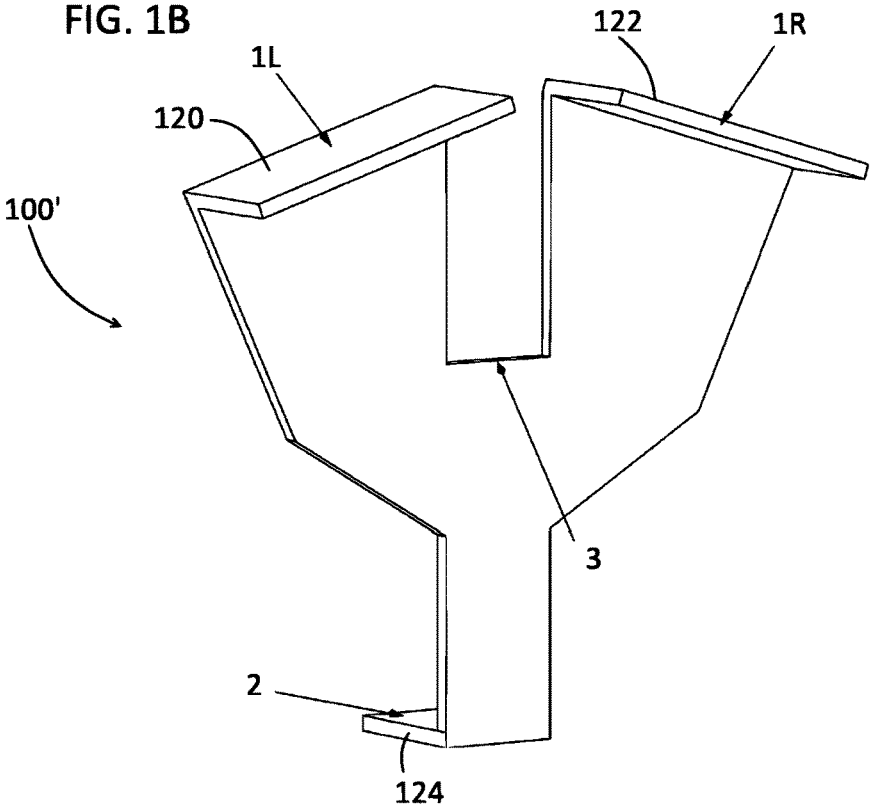
FIG. 1B is a perspective view of another embodiment of the invention showing I-shape' type top and bottom brackets.
Figure 1C:
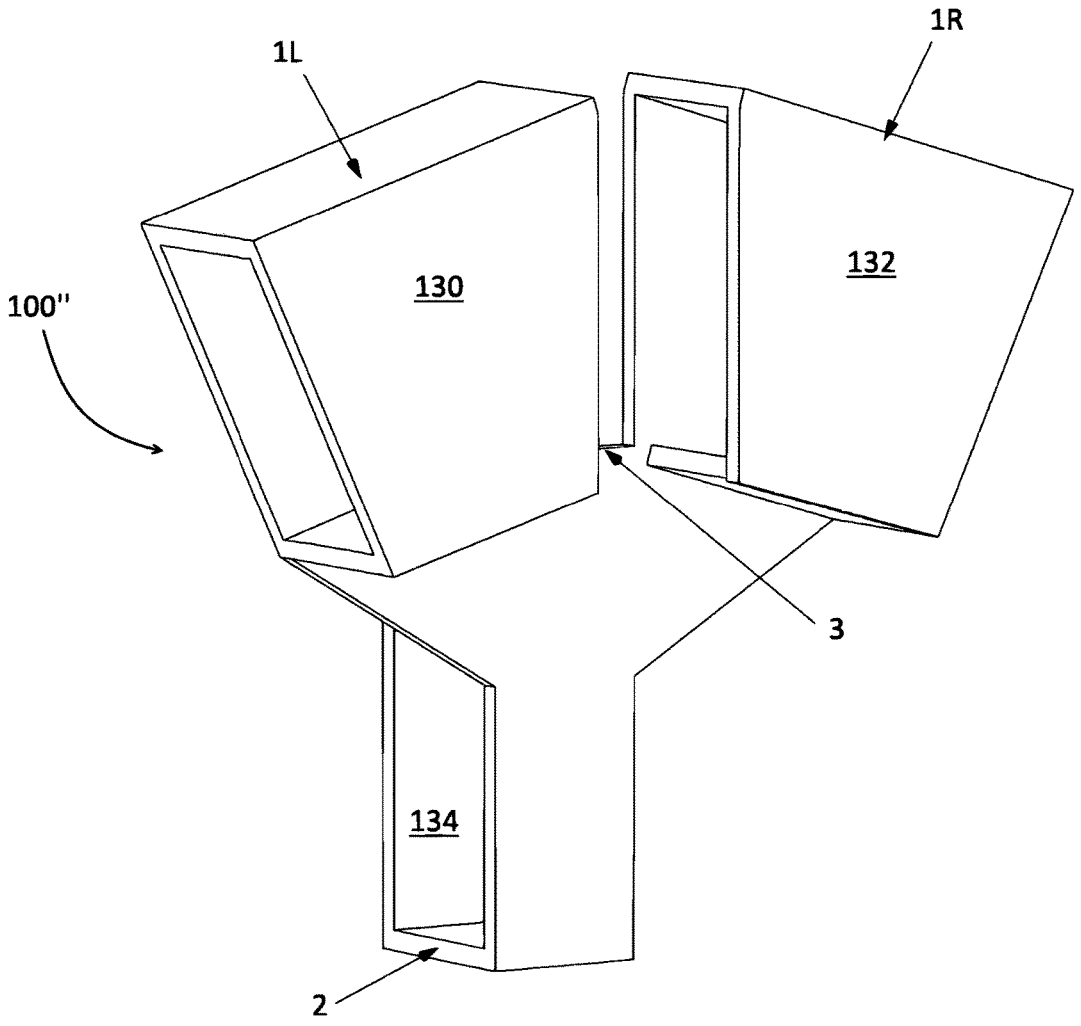
FIG. 1C is a perspective view of another embodiment of the invention showing 'Fully-enclosed' type top and bottom brackets.
Figure 1D:
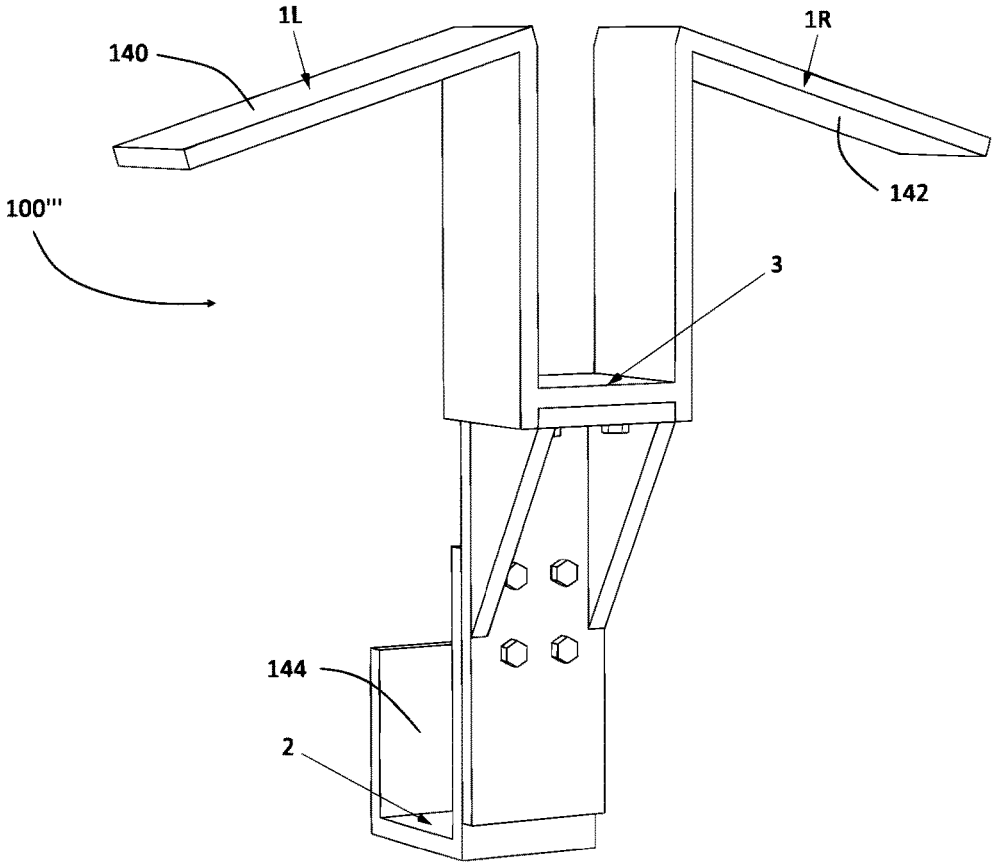
FIG. 1D is a perspective view of yet another embodiment of the invention showing 'Wing' type' top brackets with a 'U-shaped' type bottom bracket.
Figure 1E:
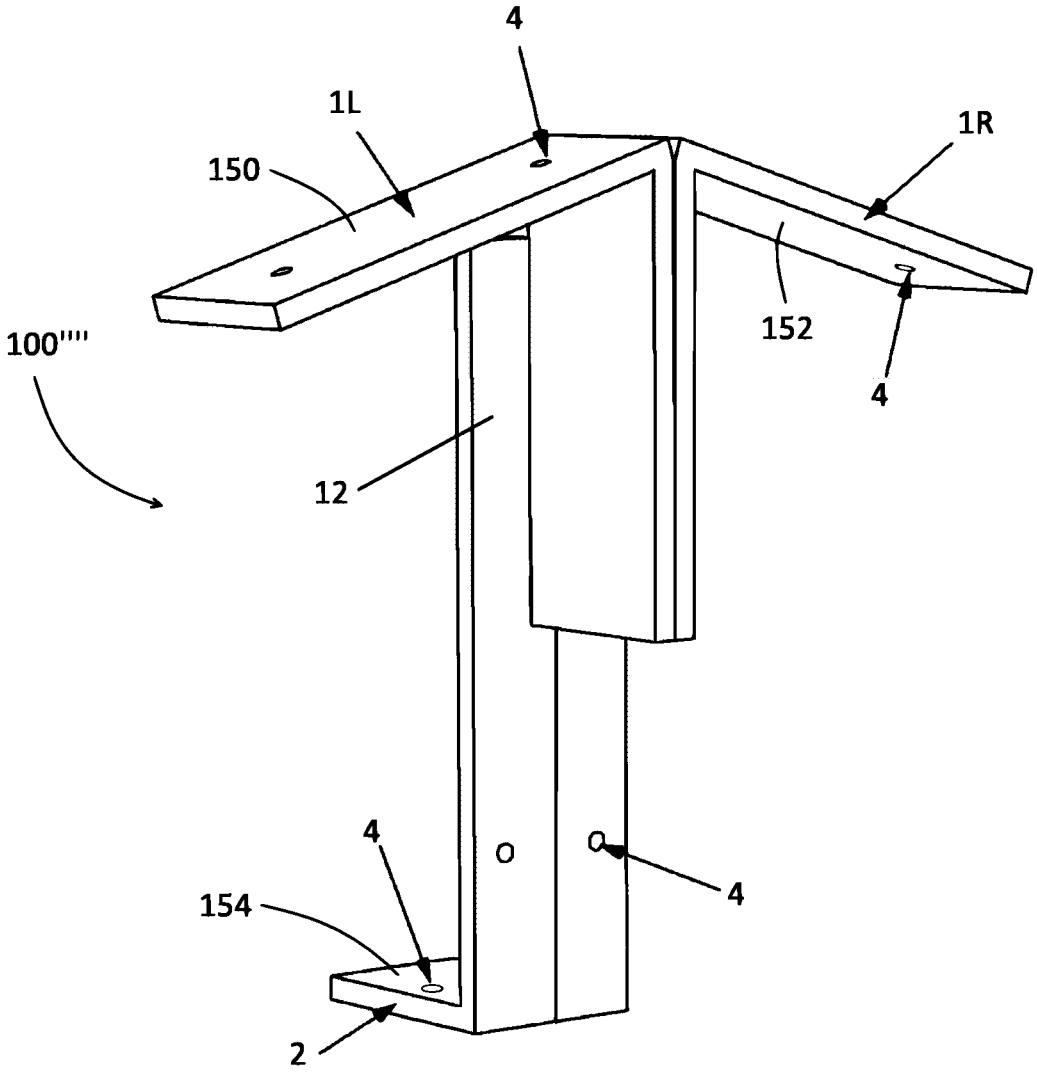
FIG. 1E is a perspective view of an embodiment of the invention showing the connector configured without a transverse notch between the two top brackets. This embodiment is illustrated with exemplary 'Wing' type top brackets and an 'L-shape' type bottom bracket.

FIGS. 1A-1E illustrate five embodiments of the inventive connector 100 illustrating different types of brackets and transverse notch options. FIG. 1A shows 'U-shaped' brackets 110-114, which allow the beams to enter the top brackets from below and to control the lateral movement of the beams without fasteners. FIG. 1B shows 'L-shaped' brackets 120, 122, and 124 in a connector 100' which allow the beams to enter the top brackets 120, 122 from the side as required for the top three beams of an arch assembled by cantilevering. The bottom bracket in connector 100' is shown at 124. Bolts, screws or other fasteners are required to keep the beam in place in 'L-shaped' brackets. FIG. 1C shows 'Fully-enclosed' brackets 130, 132, and 134 in a connector 100" which are used in applications where the ends of the stringer beams require protection from the weather, e.g., with bamboo stringer beams. The top brackets are shown at 130 and 132, and the bottom bracket is shown at 134. FIG. 1D shows 'Wing' type top brackets 140 and 142 in a connector 100'''. In this embodiment, the bottom bracket is selected to be a U-shaped bracket 144. FIG. 1E shows 'Wing' type top brackets 150 and 152 in a connector 100'''' configured without a transverse notch. In this embodiment, the bottom bracket in connector 100'''' is selected to be an L-shaped bracket 154. The brackets in FIG. 1E are shown with holes 4 for bolts or other fasteners that are to be used to retain the beams in the brackets.

Figure 2:
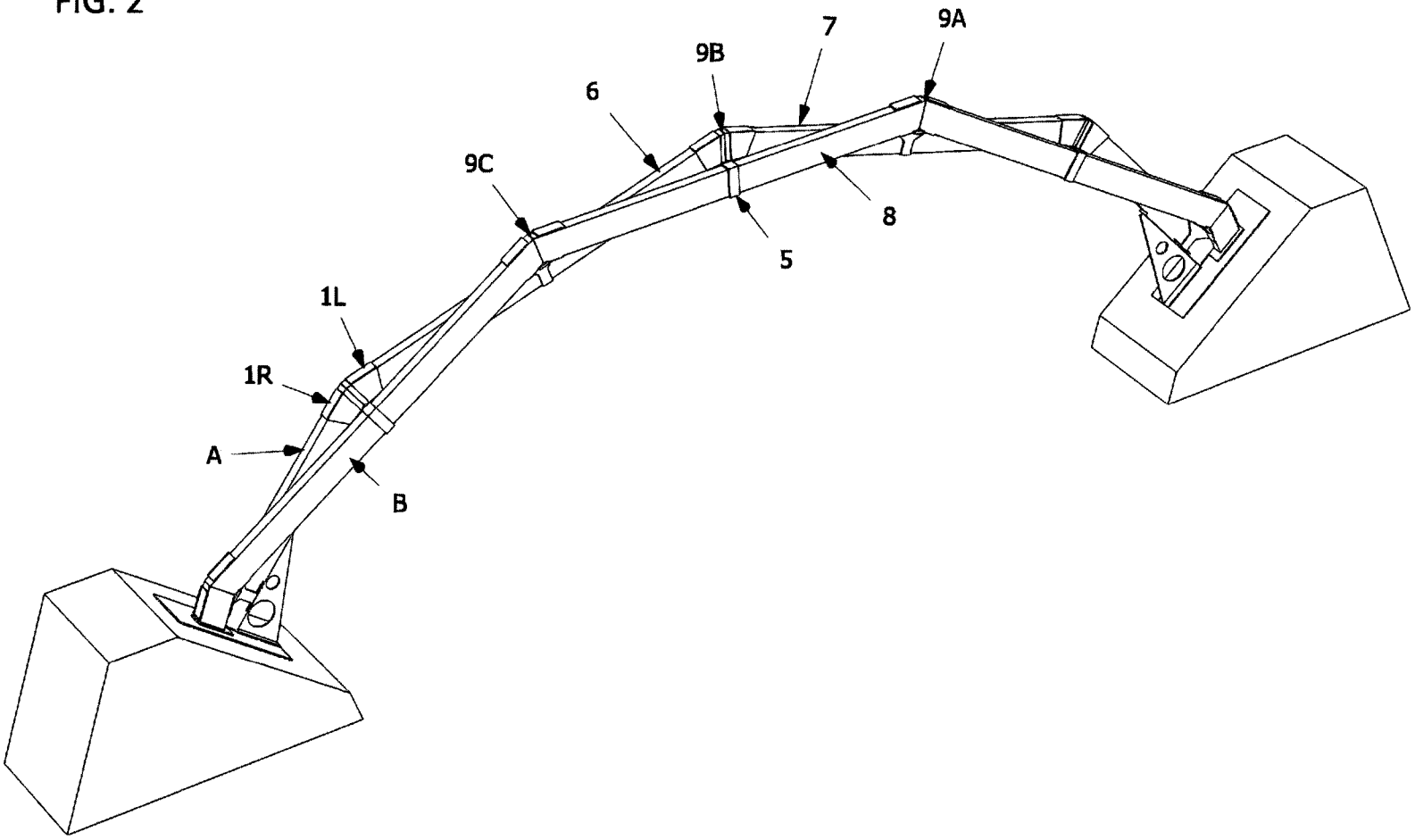
FIG. 2 is a perspective view of a single row polygonal arch structure created with the invention constructed using Y-shaped connectors according to the present invention.

As shown in FIG. 2, the purpose of the inventive connector, an example of which is shown at 5, is to join straight beams 6, 7, 8 in a triangular union that forms one node, e.g., node 9B, of a multi-row polygonal arch structure. FIG. 2 illustrates that, at each node of a double row polygonal arch, two beams 6, 7 which are adjacent sides of a polygon meet end-to-end at an obtuse angle next to the midsection of a third beam 8. The beams that meet end-to-end 6, 7 at the node are in one row A of the arch and the third beam 8 is in the other row B of the arch. A series of these 'nodes' 9ABC creates two polygonal arcs of straight beams which are staggered with respect to each other by one-half the length of a beam. Using the beam numbered 8 as an example, each beam in the structure belongs to three 'nodes': one node at each end of the beam 9A, 9C, and one node at its midpoint 9B.

Figure 3A:
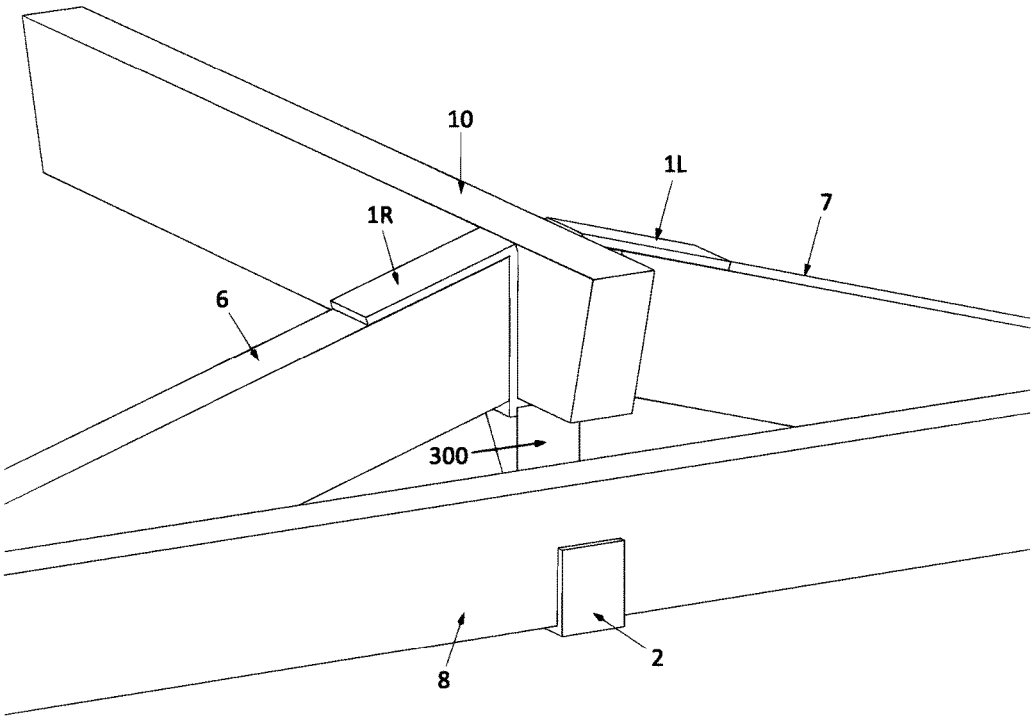
FIG. 3A is a front perspective view of one node of a double row polygonal arch created with the invention which shows the invention with two stringer beams inserted into the top brackets, one stringer beam inserted into the bottom bracket and a transverse beam inserted in the transverse notch.
Figure 3B:
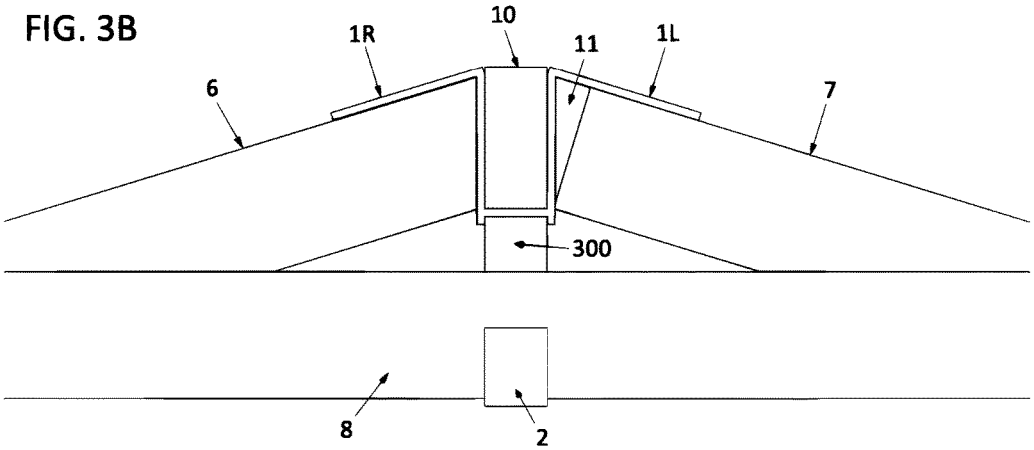
FIG. 3B is a front view of one node of a double row polygonal arch showing the use of a triangular shim to allow rectangular-ended beams to be inserted into the top brackets.

FIG. 3A gives a detailed view of one node created with a 'Wing' type connector 300 showing the stringer beams 6, 7, 8 inserted into the two top brackets 1L and 1R, and the bottom bracket 2, respectively. A partial view of a transverse beam 10 is shown with one end inserted into the transverse notch between the ends of beams 6 and 7. FIG. 3B is a front view of one node of a double row polygonal arch showing the use of a triangular shim 11 to allow rectangular-ended beams to be inserted into the top brackets.

Elements of the Invention

Figure 4A:
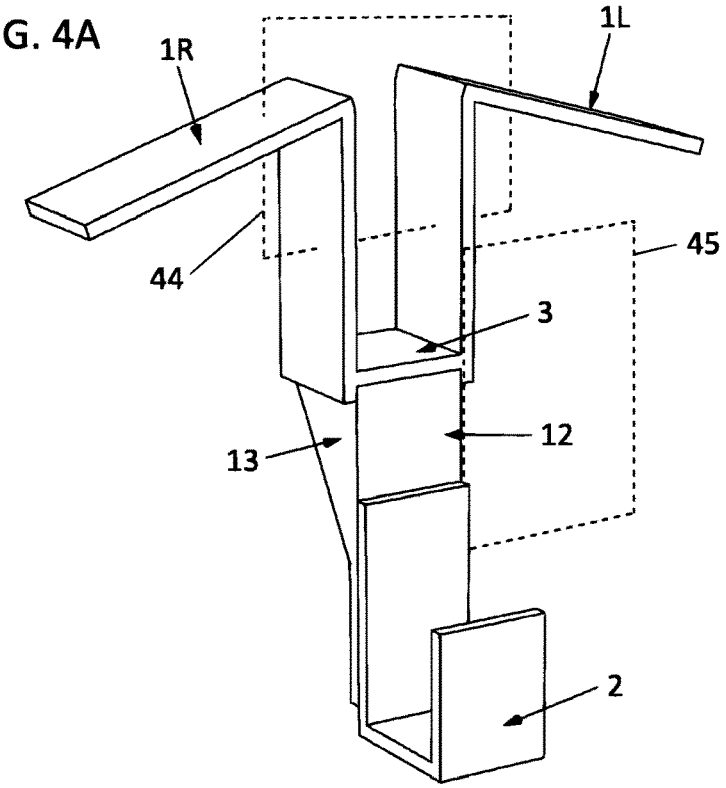
FIG. 4A is a front perspective view of one embodiment of the present invention shown as an assembly of the three primary elements: top brackets, a bottom bracket, and a central structure.

Top Brackets: Each Y-shaped connector has two top brackets 1L, 1R, as illustrated in FIG. 4A. Each top bracket provides a joinery-free connection to a node of a double row polygonal arch for the end of a stringer beam.

Any method of attaching the end of a stringer beam to a node of a double row polygonal arch that does not require joinery which interlocks or overlaps the beam with either the end of the stringer beam in the opposite top bracket or the transverse beam is considered a top bracket. All top brackets allow disassembly of the attachment between the stringer beam and the top bracket, and reuse of the bracket and beam.

Each top bracket holds the stringer beam at a downward sloping angle relative to the upper transverse plane 43 of the connector (as seen in FIG. 1A). The slope of the top bracket establishes the shape of the arch at that 'node'. The connector can be made with two top brackets that have different downward sloping angles to create non-circular arches.

Each top bracket can have holes 4, as shown in FIG. 1E, and one or more flanges or other features for securing the stringer beam in each bracket in a Y-shaped connector according to the present invention. The geometry of the arch and the normal forces produced by the weight of the arch hold the stringer beams in the 'U-shaped' and 'Fully-enclosed' types of top brackets without fasteners. Fasteners can be added for convenience, safety or durability as required by the application.

Transverse Notch: Referring to FIG. 4A, each connector may have a space between the top brackets termed the transverse notch 3. The transverse notch can be used for various purposes including: adding a transverse beam to the node, suspending a load from the arch, housing a lifting device for dynamically controlling the curve of the arch, or attaching decorative elements to the 'nodes'. The transverse notch is created by constructing the central structure 12 of the connector with the required space between the top brackets.

Bottom Bracket: Each connector has one bottom bracket 2. The bottom bracket is constructed to attach the connector to the midsection of a stringer beam. In operation, bottom bracket applies an upward force on the stringer beam. The upward force is generated by the outward thrust produced by loads on the arch or by the weight of the cantilevered portion of the arch which is transferred to the connector through the top brackets and countered by the stringer beam in the bottom bracket.

The bottom bracket may be configured as "L-shaped", "U-shaped", "Fully-enclosed" or simply as a flat plate of material extending down from the top brackets with one or more bolts used to attach the plate to the stringer beam.

Central Structure: As shown in FIG. 4A, the central structure 12 is the part of the connector which joins the top brackets 1L and 1R to the bottom bracket 2.

Figure 4B:
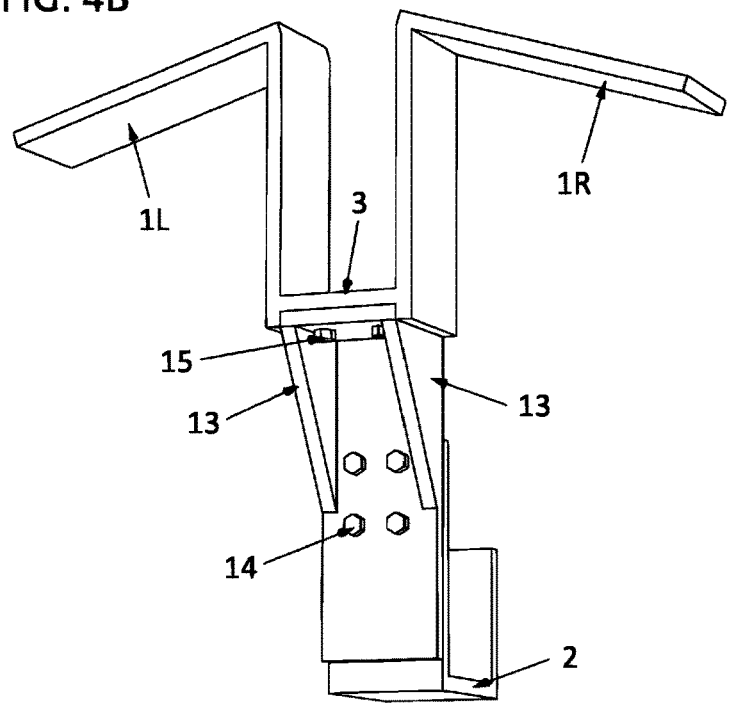
FIG. 4B is a rear perspective view of the invention shown in FIG. 4A.

The central structure is a general term for the elements of the connector which are not included in the top brackets or bottom bracket. The central structure:

separates the top brackets to create the transverse notch 3, when present aligns the top and bottom brackets so the top brackets are centered on the same longitudinal plane 44 and are located on the opposite side of the vertical plane 45 of the connector from the bottom bracket contains braces 13 to make the connector more rigid when needed, FIG. 4B shows the rear view of the central structure. Bolts 14 or other suitable fasteners attach the bottom bracket to the central structure when the bottom bracket is a separate part. Likewise, bolts 15 or other suitable fasteners join the top brackets to the central structure when they are separate parts.

Figure 5A:
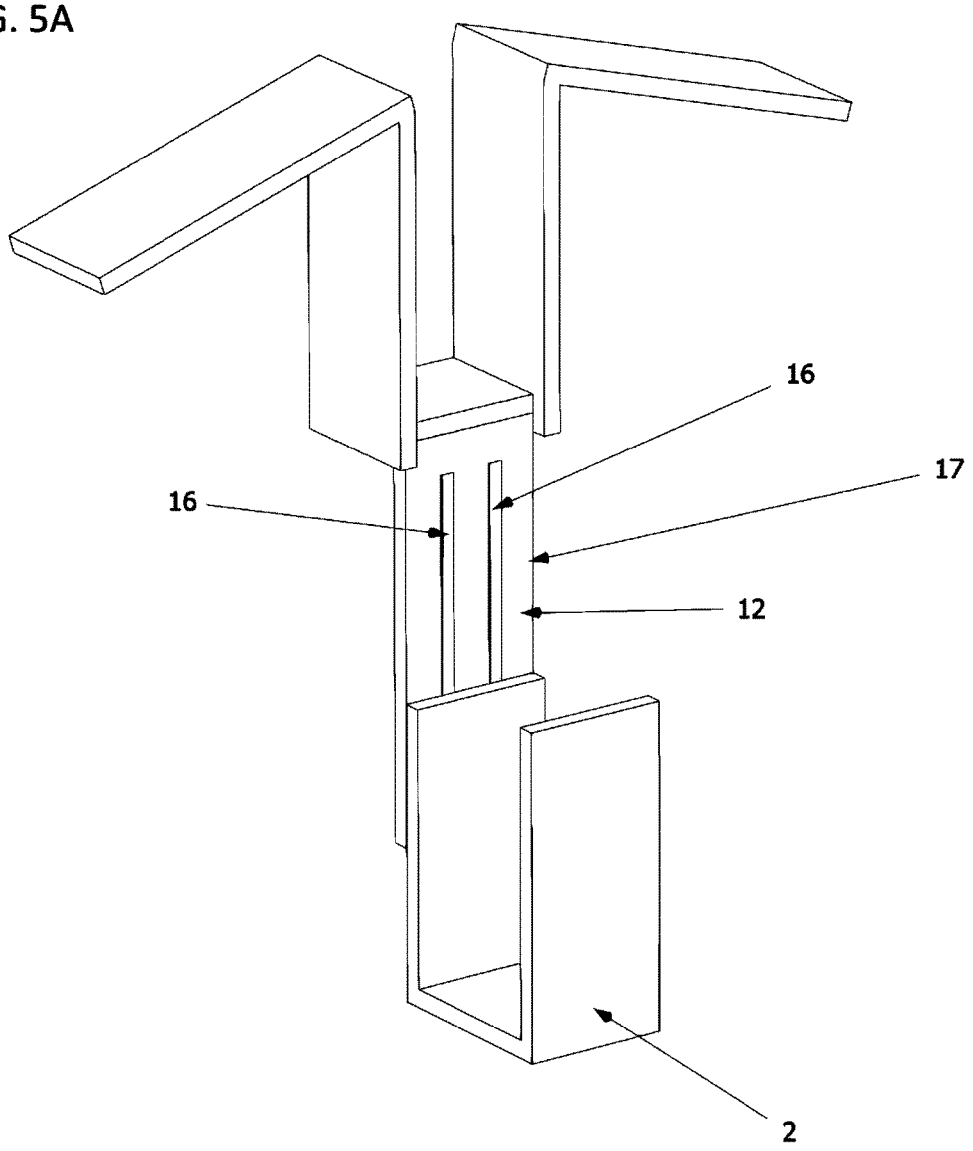
FIG. 5A is a perspective view of one embodiment of the invention with 'configurable vertical spacing', showing a central structure that has vertical slots which allow the bottom bracket to be selectively fixed at one of a variety of distances from the top brackets. In this figure, the bottom bracket is shown at the lower end of the range of travel.
Figure 5B:
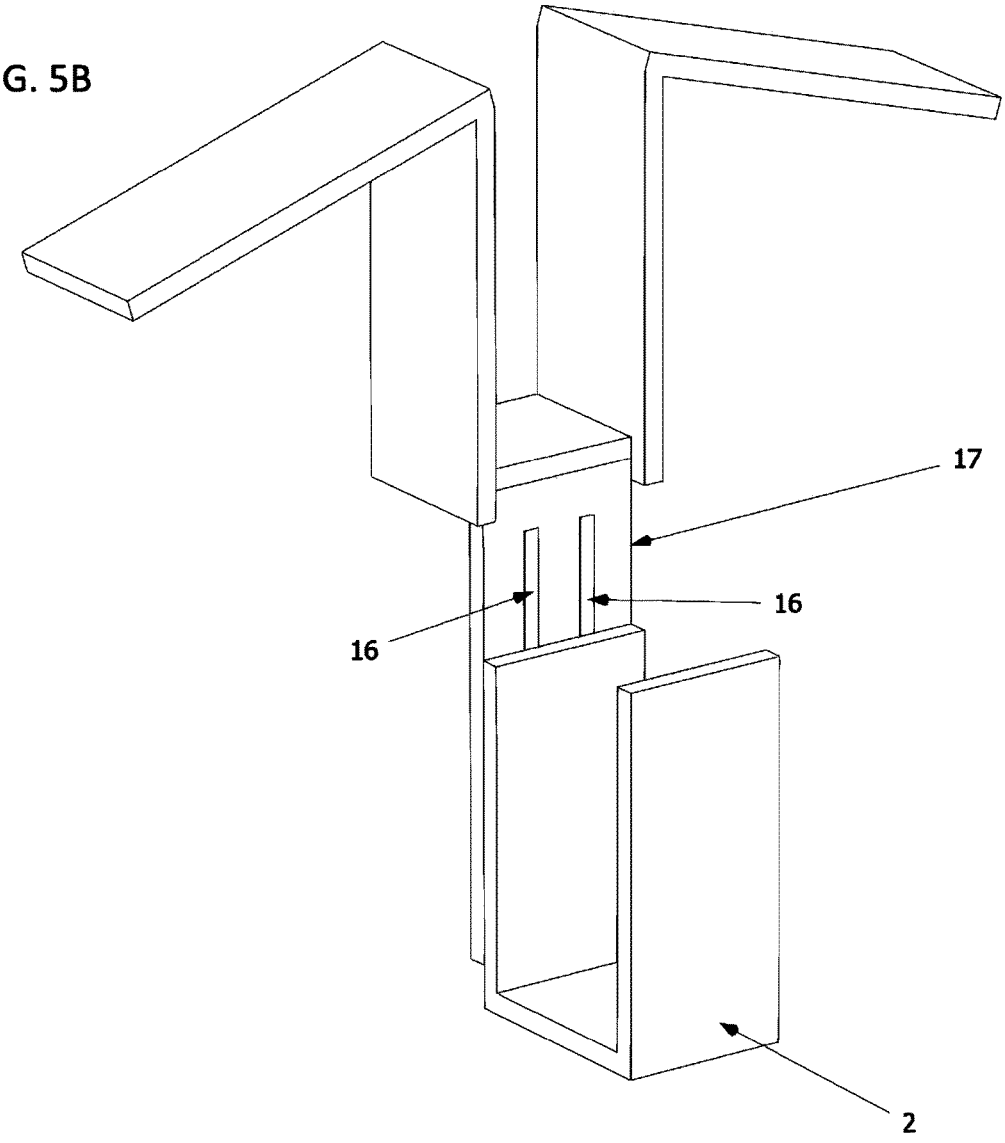
FIG. 5B is a front perspective view of the invention shown in FIG. 5A with the bottom bracket at the middle of the range of travel.
Figure 5C:
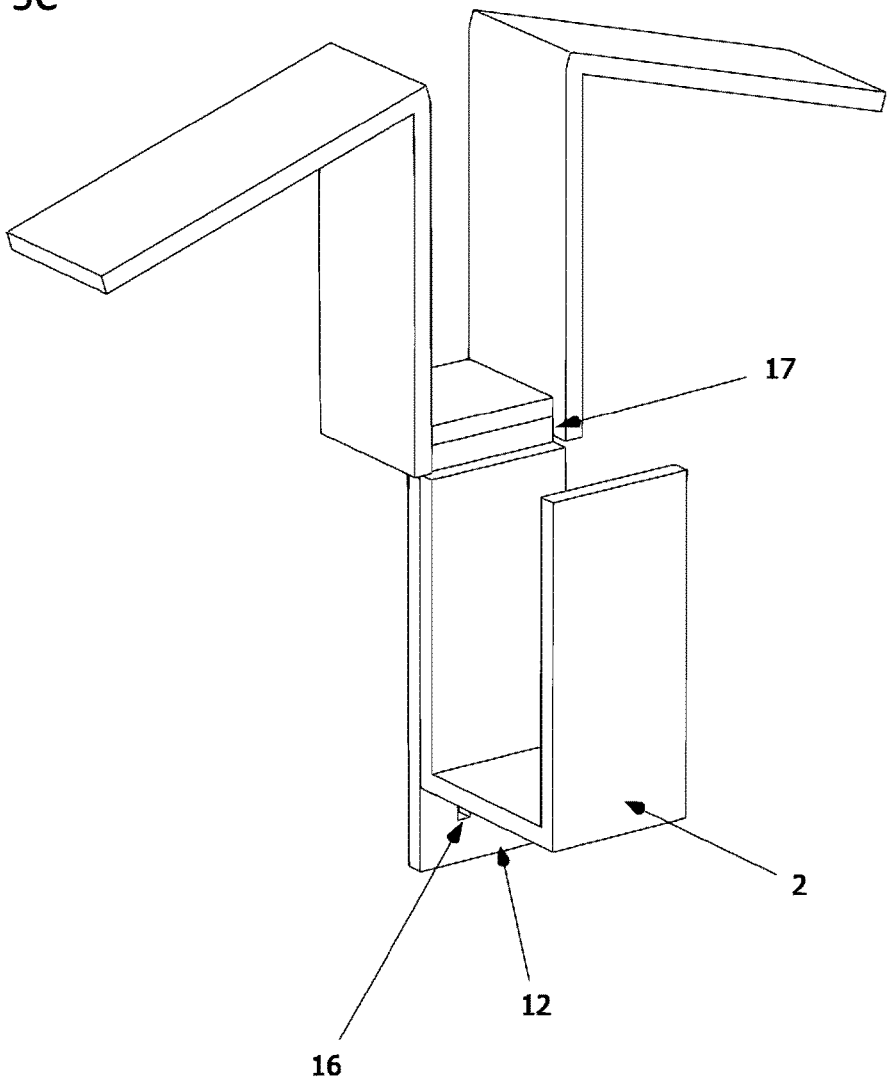
FIG. 5C is a front perspective view of the invention shown in FIG. 5A with the bottom bracket at the top of the range of travel.

As illustrated in FIG. 5A, the central structure can have vertical slots 16 or tracks which enable the vertical position 17 of the bottom bracket to be adjusted by sliding the bottom bracket up or down along the central structure 12 of the connector. FIGS. 5A, 5B, and 5C show the bottom bracket 2 moving from the end of the range of travel with the greatest separation from the top brackets up to the level of the least separation.

Figure 5D:
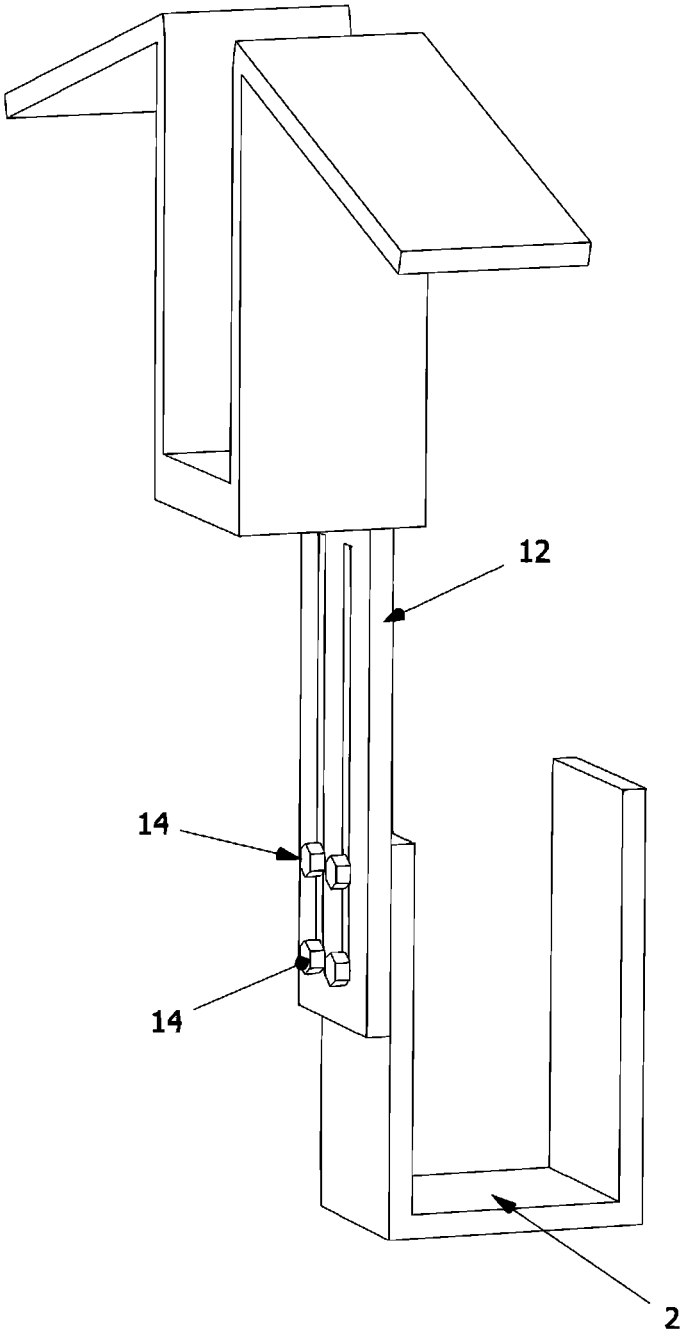
FIG. 5D is a rear perspective view of the invention shown in FIG. 5A, showing use of bolts to attach the bottom bracket to the central structure through the two slots.

FIG. 5D shows a typical implementation of the moveable bottom bracket using multiple bolts 14 to keep the bottom bracket aligned with the connector. A single fastener in a single slot can also be used.

The sliding bottom bracket allows one connector to be used with beams of different lengths creating different spans for the arch.

The central structure 12 with one or more slots or tracks can be constructed to extend up to the top of the top brackets or beyond, extending both above and below the top brackets. Sliding the bottom bracket from below to above hinged top brackets causes the arch to first collapse to a straight row of beams and then curve up rather than down.

Figure 6:
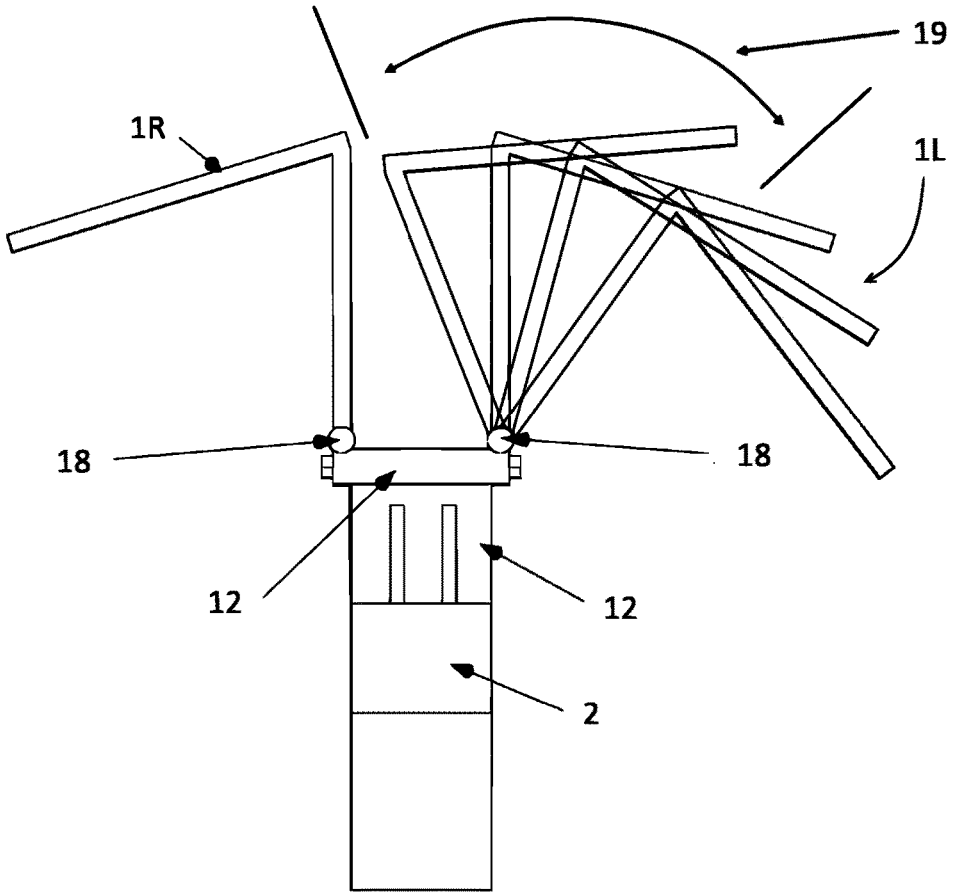
FIG. 6 is a front view of an embodiment of the present invention illustrating the top brackets connected to the central structure of the Y-connector with hinges.

One or more embodiments of the invention may form the central structure part as part of the top or bottom brackets. In these embodiments, a portion of a top bracket or bottom bracket element performs the function of the central structure. FIG. 1E illustrates a central structure 12 that is an extension of the same piece of material as the bottom bracket, Top Bracket Mounting Using Hinges, Pivots or Flexible Material: The invention, as illustrated in FIG. 6, includes the optional attachment of top brackets to the central structure 12 with hinges 18, pivots or flexible material that have an axis of rotation that is perpendicular the vertical plane of the connector. Mounting the top brackets on hinges or pivots enables a connector to be used with a variety of beam lengths, thereby extending the range of applications in which it can be used. Hinge-mounted top brackets can be used in conjunction with the moveable bottom bracket shown in FIG. 5 or as an alternative. Top brackets can rotate through a range of angles 19. The range of angles includes, but is not limited to, the angles required to form a double row or multi-row polygonal arch.

The pivot can be located anywhere along the top, bottom or transverse-notch-facing end of the top bracket. FIG. 6 illustrates a typical location for the hinge: the point at which transverse-notch-facing end of the top bracket meets the 'notch floor'.

Figure 7A:
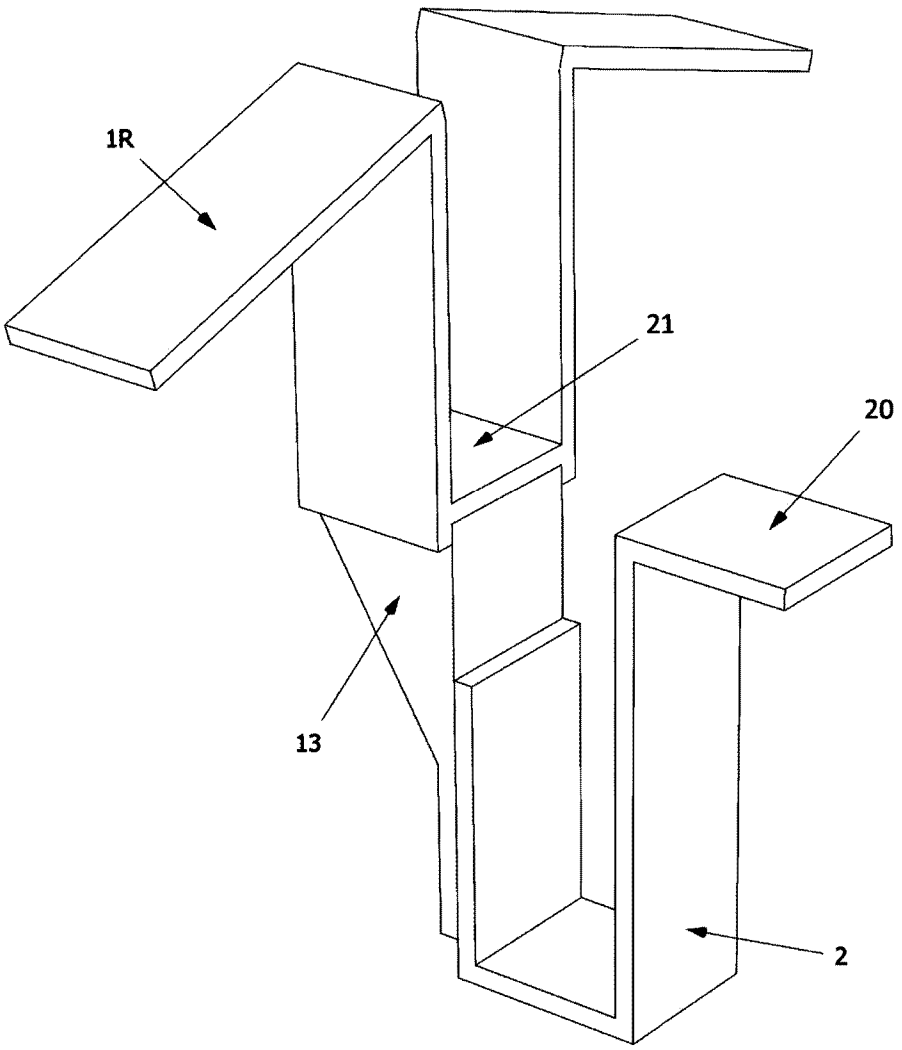
FIG. 7A is a perspective view of an embodiment of the invention with the bottom bracket configured with a 'chaining hook'.
Figure 7B:
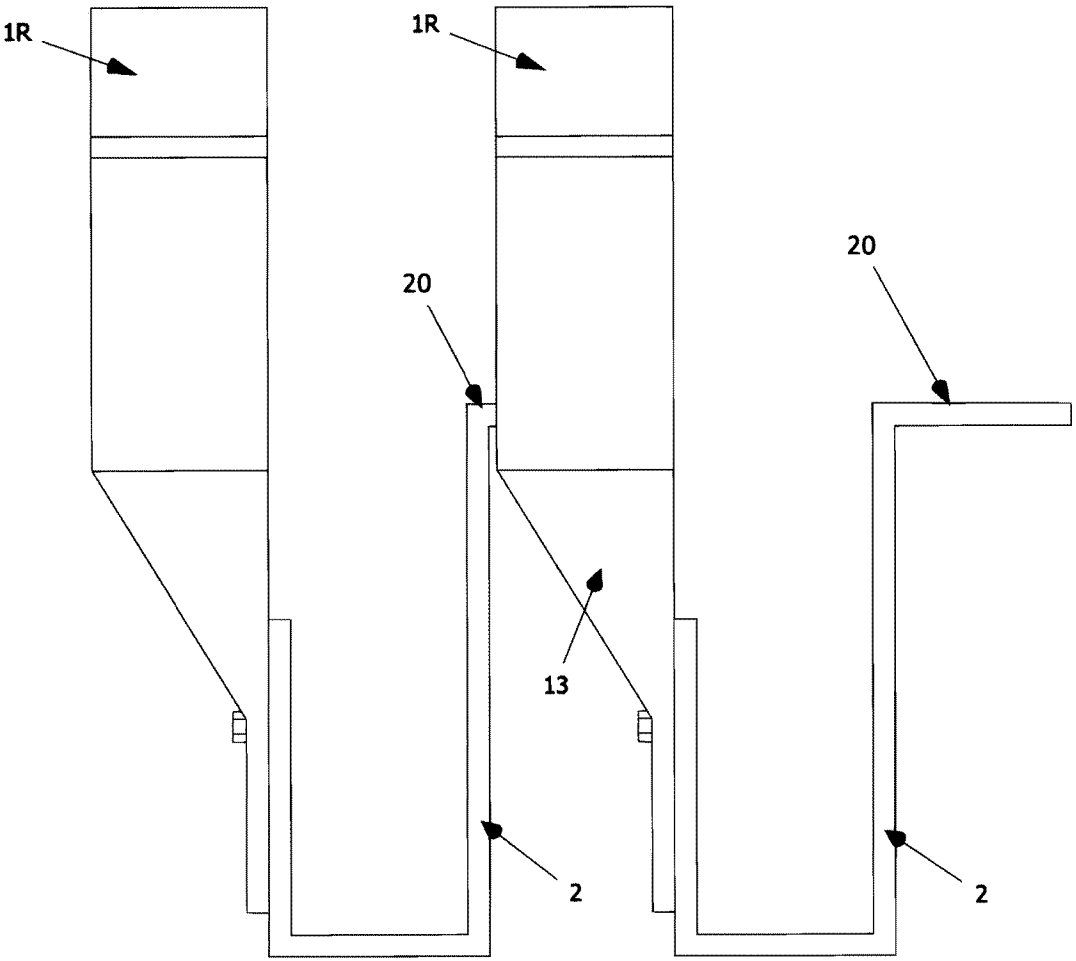
FIG. 7B is a side view an embodiment of the invention where two Y-shaped connectors with a 'chaining hooks' are nested, with the 'chaining hook' of one connector resting on the 'notch floor plate' of the adjacent connector.

Chaining Hook: One embodiment of the invention includes a 'chaining hook' 20, as illustrated in FIG. 7A, which is an extension of the 'outer side wall' of the bottom bracket 2 that folds outward away from the connector just above the level of the 'notch floor plate' 21. As shown in FIG. 7B, the 'chaining hook' fits into the transverse notch of an adjacent connector.

In structures with two immediately adjacent double-row polygonal arches, the 'chaining hook' 20 acts to counteract the torque that can develop at each node under load. Each Y-shaped connector tends to rotate toward the bottom bracket under load as outward thrust in the top bracket 1R is resisted by the bottom bracket. The 'chaining hook' both stops that rotation for its own connector and counters the rotation in the adjacent connector with the force it applies. Braces 13 can increase the value of the 'chaining hook' by making the central structure and bottom bracket 2 more rigid.

The 'chaining hook' can also fasten two adjacent double-row arches together by adding holes for fasteners to the 'chaining hooks' 20 and 'notch floor plates' 21.

Building Blocks: The invention, as illustrated in FIG. 8, establishes a 'building block' for double row or multi-row polygonal arch structures. The 'building block' consists of one connector 5 and one stringer beam 8 attached by the bottom bracket 2 of the connector at the midsection of the beam. Two 'building blocks' facing in opposite directions interlock when the 'building blocks' are pushed together so that one end of the stringer beam of each block is fully inserted into a top bracket 1L,1R of the other block. This interlocking feature enables the building of a double row polygonal arch from identical modules.

FIG. 8 shows a building block made with a connector with 'L-shaped' top brackets. This type of building block can be added to the arch by sliding it sideways onto other building blocks. 'L-shaped' brackets preferably have holes 4 for fasteners to keep the beams in the bracket.

Additionally, arches can be constructed using non-identical 'building blocks' which are designed to interlock with just the adjacent blocks of the structure. Non-identical 'Building blocks' can be asymmetrical to create parabolic and non-semi-circular arches. To create a parabolic or other non-circular arch, the length of the beams and the angles of the top brackets can be unique to every 'building block'. Each 'building block' may also be unique with respect to the location at which the bottom bracket is attached to the beam: exactly at the midpoint or offset from the midpoint toward one end of the beam.

Referring to FIG. 9, the ends of the arch preferably connect to a foundation or abutment 22 using an 'abutment connection bracket'. The 'abutment connection bracket' has a hinged 'locking angle' 23, a 'stub-beam' 24 and, optionally, a 'cantilever support brace' 25 fastened to a metal plate 26 which is bolted to the abutment 22. The 'locking angle' 23 is the cantilever anchor during cantilevered construction and the bracket which transfers outward thrust from the arch to the abutment in a completed arch. The 'stub beam' fits into the 'abutment-facing top bracket' of the 'building block' preventing lateral motion at the end of the arch.

The 'stub beam' 24 of the 'abutment connection bracket' is a solid or tubular duplicate of the end of a stringer beam. The stub beam is welded or fastened to the 'abutment connection plate' 26 at an angle matching the angle of the top bracket of the springer 'building block'.

The 'locking angle' 23 is attached to the 'abutment connection plate' 26 by a hinge 27 with the axis of rotation parallel to the ground. The hinge is mounted such that the lower wall 28 of the 'locking angle' is flush with the 'abutment connection plate' 26 at one end of the range of travel and at 90 degrees to the plate at the other end of the range of travel. The lower wall of the 'locking angle' is as tall as the depth of the springer 'building block beam' and at least as wide as the beam.

The 'cantilever support brace' 25 is located immediately below the 'locking angle' and extends at 90 degrees from the 'abutment connection plate' 26. The 'cantilever support brace' is only used when the arch is constructed by cantilevering. The 'cantilever support brace' supports the springer 'building block' whose beam is the sole support for the entire cantilevered portion of one side of the arch during cantilevered construction.

The 'cantilever support brace' 25 has a notch 29 in the upper face of the brace to allow room for the 'bottom wall' of the bottom bracket of the springer 'building block'. The length of the 'cantilever support brace' is application-specific. The 'cantilever support brace' is welded or bolted to the metal plate. The 'cantilever support brace' can be removed and reused once the 'keystone building block' is in place.

Referring to FIG. 10A, the springer 'building block' 30 is attached to the 'abutment connection bracket' 31 by sliding the lop bracket' 1R onto the 'stub beam' 24. The 'locking angle' 23 is held at the upper extent of the hinge's range of travel until the 'building block beam' 32 in the 'bottom bracket' touches the lower wall of the 'locking angle' initiating the rotation of the 'locking angle'.

The abutment-facing end of the beam of each springer 'building block' is shortened to fit the 'abutment connection bracket'. The beam is cutoff at 90 degrees. The position of the cutoff is calculated so that the cutoff face of the beam end will rest squarely on the lower wall of the 'locking angle' 28 when the 'stub beam' 24 is fully inserted into the 'top bracket' of the springer 'building block' 30 and the arch is loaded. FIG. 10A shows the point at which the springer 'building block beam' 32 first contacts the 'locking angle'. FIG. 10B shows the locking angle 23 rotating as the stringer beam descends to the abutment connection plate' 26 guided by the locking angle. FIG. 10C shows the final position of the springer 'building block' 30 and the 'locking angle' 23.

The 'abutment connection bracket' may have multiple 'stub beam' and a 'locking angle' pairs so that multiple parallel arches to be connected to the abutment with one bracket.

Cantilevered Construction:

The invention enables a double-row polygonal arch to be assembled in its final location and vertical orientation from the abutments without any other scaffolding or support as illustrated in FIG. 11. FIG. 11 shows a structure consisting of four double-row polygonal arches: A through D, each arch at a different level of completion and all being built by the same method using cantilevering.

Assembly Procedure:

1. Attach the 'abutment connection bracket' 31 to the abutment 22 See Arch A.
2. Cut off one end of the beam of the springer 'building block' 30 as specified in the 'abutment connection bracket' description.
3. Attach a springer 'building block' 30 to the 'abutment connection bracket' 31, as shown in Arch A.
4. At the second and subsequent arches, optionally add a 'transverse beam' to the 'transverse notches' of adjacent connectors joining neighboring arches at the 'nodes' as shown on the left side of Arches A through D.
5. Slide the 'abutment-facing top bracket' 35 of a standard 'building block' 33 onto the end of the current highest 'building block' in the half-arch, as shown in Arch B.
6. Repeat steps 4 and 5, alternating the direction in which the 'building blocks' are facing, until half of the arch is complete, as shown in Arch C.
7. Repeat steps 1 through 5 from the other side of the span.
8. Slide the 'keystone building block' 34 onto the voussoir 'building blocks' 36 of each side of the span, as shown in Arch D. In arches with an even number of connectors, there are two connectors at the same level at the top of the arch. In these cases, the last 'building block' added to the arch is considered the 'keystone building block'. In cantilevered assembly, the 'keystone building block' is added by sliding it into the arch from the side.

Tied Beam Connection for Tied Arches: The connector supports creating a tied arch, as illustrated in FIG. 12, by connecting the springer 'building blocks' 37 to opposite ends of a tie beam 39: An 'abutment connection bracket' without the 'support brace' is fastened to the end of the tie beam by a locally engineered solution. The 'springer building block' connects to the 'abutment connection bracket' as it would with an abutment-mounted bracket.

Multi-Rib Arch Structures: The invention enables multiple double-row polygonal arches to be connected into larger, multi-rib structures by transverse beams 10 inserted in the 'transverse notch' 3 of the inventive connectors in each arch, as seen in FIG. 13. A primary feature of the invention is that the transverse beams at each node are located between the ends of the load-bearing stringer beams 8, 9, rather than above or below the beam-to-beam interface through which loads pass to the abutments. When an arch made with the invention is loaded, the transverse beams are held securely by the compression forces transmitted along each row of beams in the arch.

Symmetrical Connectors: A variant of the double-row polygonal arch which has 3 rows of beams can be created by combining two standard connectors into one connector. Two combinations are possible: 'front-to-front' and tack-to-back'. 'Front-to-front' connectors, as shown in FIG. 14B, have a single common 'bottom bracket' 2 and four lop brackets' 1L, 1R. Back-to-back, as shown in FIG. 14A, connectors have two 'top brackets' 1L, 1R in common and two 'bottom brackets' 2. Unlike the standard connectors which are the same at every 'node' of an arch, the two types of 3-row connectors must alternate around the arch to produce polygonal rows of beams.

The 3-row arch has value as a decorative structure. The 3-row arch can be used for structures if the beams in the center row are increased in size to be equal in load-bearing capacity of the two outer rows.

Hinges and Pivots: The hinges and pivots described and illustrated represent generic, off-the-shelf components or application-specific engineered connections that have the axis of rotation indicated and perform the function described. The illustrations are not necessarily drawn to scale. Flexible material such as fabric can serve as a hinge in some applications. Custom engineered solutions and integration of the hinge function into elements of the connector are include as options where hinges or pivots are included in the invention

What is claimed is:

1. A connector for forming one of a plurality of nodes for connecting stringer beams to form an arch structure having two rows of stringer beams joined by the connector at each node, said connector comprising:

two top brackets forming the arms of said connector, each top bracket aligned with the other top bracket so that they are mirror images of each other relative to a vertical midplane of said connector, each top bracket having an upper surface that extends down at an angle on each side of said vertical midplane of said connector relative to an upper transverse plane defined by the top of said connector to form one surface of each top bracket for securely retaining a stringer beam therein;

a bottom bracket forming the foot of the connector; and a central structure forming the body of the connector for rigidly interconnecting the two top brackets to said bottom bracket, said central structure defining a vertical plane perpendicular to said vertical midplane and said upper transverse plane, said bottom bracket having an upward facing surface that defines a lower transverse plane parallel to said upper transverse plane and perpendicular to the vertical plane of said central structure and said vertical midplane;

wherein the two top brackets are located on one side of the vertical plane of said central structure and the bottom bracket is located on the other side of the vertical plane of said central structure, such that stringer beams inserted into said top brackets can extend out in opposite directions from said vertical midplane along one side of the vertical plane defined by said central structure and in a direction towards said bottom bracket transverse plane, and such that a stringer beam inserted into the bottom bracket extends along the other side of the vertical plane defined by said central structure, whereby the ends of stringer beams in one row are opposite the midsection of stringer beams in the other row at each node.

2. The connector of claim 1, further comprising a slot formed in said central structure between said two top brackets for enabling a transverse beam to connect connectors positioned in corresponding locations in one or more adjacent arch structures.

3. The connector of claim 1, wherein the top brackets are L-shaped.

4. The connector of claim 1, wherein the top brackets are U-shaped.

5. The connector of claim 1, wherein the top brackets have fully enclosed sides.

6. The connector of claim 1, wherein each said top bracket is fastened to the central structure with a hinge, such that the angle of the upper surface of each top bracket can be independently adjusted to a desired angle.

7. The connector of claim 1, further comprising a chaining hook formed on said bottom bracket to enable at least two connectors to be fastened together.

8. The connector of claim 1, further comprising a triangle shaped shim positioned in each top bracket to enable use of a rectangular-ended stringer beam to be inserted into each top bracket and rest flush against the shim.

* * * * *